US008599101B2

(12) United States Patent
Christie et al.

(10) Patent No.: US 8,599,101 B2
(45) Date of Patent: Dec. 3, 2013

(54) DIELECTRICALLY LOADED ANTENNA AND RADIO COMMUNICATION APPARATUS

(75) Inventors: Andrew Robert Christie, Northamptonshire (GB); David Michael Wither, Northamptonshire (GB); Martyn Leslie Tongue, Leicestershire (GB); Frank Kwasi Frimpong, Northhamptonshire (GB)

(73) Assignee: Sarantel Limited, Wellingborough (GB)

( * ) Notice: Subject to any disclaimer, the term of this patent is extended or adjusted under 35 U.S.C. 154(b) by 371 days.

(21) Appl. No.: 13/014,984

(22) Filed: Jan. 27, 2011

(65) Prior Publication Data

US 2011/0221651 A1 Sep. 15, 2011

Related U.S. Application Data

(60) Provisional application No. 61/313,222, filed on Mar. 12, 2010.

(30) Foreign Application Priority Data

Jan. 27, 2010 (GB) ..... 1001331.6

(51) Int. Cl.
*H01Q 1/36* (2006.01)

(52) U.S. Cl.
USPC ..... 343/895; 343/702

(58) Field of Classification Search
USPC ..... 343/895, 700 MS, 702, 906, 850
See application file for complete search history.

(56) References Cited

U.S. PATENT DOCUMENTS 5,092,783 A 3/1992 Suarez et al.
7,002,530 B1 2/2006 Chung et al.

(Continued)

FOREIGN PATENT DOCUMENTS

CN 2 899 134 Y 5/2007
EP 0 521 511 A2 1/1993

(Continued)

OTHER PUBLICATIONS

Search Report from Great Britain Application No. 1001327.4, search dated May 13, 2010.

(Continued)

*Primary Examiner* — Hoanganh Le
(74) *Attorney, Agent, or Firm* — Alston & Bird LLP

(57) ABSTRACT

A radio communication apparatus including: (a) a backfire dielectrically loaded antenna for operation at a frequency in excess of 200 MHz comprising: an electrically insulative dielectric core of a solid material having a relative dielectric constant greater than 5 and having an outer surface including oppositely directed distal and proximal surface portions extending transversely of an axis of the antenna and a side surface portion extending between the transversely extending surface portions, the core outer surface defining an interior volume the major part of which is occupied by the solid material of the core; a three-dimensional antenna element structure including at least one pair of elongate conductive antenna elements disposed on or adjacent the side surface portion of the core and extending from the distal core surface portion towards the proximal core surface portion; a feed structure in the form of an axially extending elongate laminate board comprising at least a transmission line section acting as a feed line which extends through a passage in the core from the distal core surface portion to the proximal core surface portion, the antenna having exposed contact areas on or adjacent the core proximal surface portion; and (b) radio communication circuit means having an equipment laminate circuit board with at least one conductive layer, the conductive layer or layers having a plurality of contact terminal support areas to each of which is conductively bonded a respective spring contact positioned so as to bear resiliently against respective ones of the exposed contact areas of the antenna.

17 Claims, 15 Drawing Sheets

(56) References Cited

U.S. PATENT DOCUMENTS

| | | | | |
|---|---|---|---|---|
| 7,633,459 | B2 | 12/2009 | Christie et al. | |
| 8,125,404 | B2 | 2/2012 | Chen et al. | |
| 2003/0122726 | A1 | 7/2003 | Abbasi et al. | |
| 2003/0179144 | A1 | 9/2003 | Takesako et al. | |
| 2004/0056819 | A1 | 3/2004 | McCarthy et al. | |
| 2004/0174316 | A1 | 9/2004 | Keren | |
| 2006/0022891 | A1 | 2/2006 | O'Neill et al. | |
| 2007/0063902 | A1* | 3/2007 | Leisten | 343/702 |
| 2007/0109204 | A1 | 5/2007 | Phillips et al. | |
| 2008/0174512 | A1 | 7/2008 | Leisten | |
| 2008/0316138 | A1 | 12/2008 | Tavassoli Hozouri | |
| 2010/0231480 | A1* | 9/2010 | Leisten | 343/895 |
| 2011/0025580 | A1* | 2/2011 | Gray et al. | 343/892 |

FOREIGN PATENT DOCUMENTS

| | | | |
|---|---|---|---|
| EP | 0 791 975 | A2 | 8/1997 |
| GB | 2 292 638 | A | 2/1996 |
| GB | 2 304 463 | A | 3/1997 |
| GB | 2 309 592 | A | 7/1997 |
| GB | 2 360 398 | A | 9/2001 |
| GB | 2 399 948 | A | 9/2004 |
| GB | 2 430 309 | A | 3/2007 |
| GB | 2 432 976 | A | 6/2007 |
| GB | 2 437 998 | A | 11/2007 |
| GB | 2 441 566 | A | 3/2008 |
| GB | 2 443 308 | A | 4/2008 |
| GB | 2 444 388 | A | 6/2008 |
| GB | 2 445 478 | A | 7/2008 |
| GB | 2 462 723 | A | 2/2010 |
| JP | 10 041722 | A | 2/1998 |
| JP | 10 256818 | A | 9/1998 |
| WO | WO 98/28814 | | 7/1998 |
| WO | WO 2006/136809 | A1 | 12/2006 |
| WO | WO 2007/132161 | A1 | 11/2007 |
| WO | WO 2008/032886 | A1 | 3/2008 |
| WO | WO 2008/065376 | A1 | 6/2008 |
| WO | WO 2008/084205 | A1 | 7/2008 |
| WO | WO 2008/088099 | A1 | 7/2008 |
| WO | WO 2009/138729 | A1 | 11/2009 |

OTHER PUBLICATIONS

Search Report from Great Britain Application No. 1001327.4, search dated Nov. 8, 2010.

Search Report from Great Britain Application No. 1001330.8, search dated May 13, 2010.

Search Report from Great Britain Application No. 1001331.6, search dated May 13, 2010.

Search Report from Great Britain Application No. 1001331.6, search dated Nov. 5, 2010.

International Search Report and Written Opinion from International Application No. PCT/GB2011/050129, filed Jan. 27, 2011.

International Search Report and Written Opinion from International Application No. PCT/GB2011/050130, filed Jan. 27, 2011.

Office Action for U.S. Appl. No. 13/041,962; dated May 15, 2013.

* cited by examiner

STEP 1

STEP 2

STEP 3

STEP 4

STEP 5

CROSS SECTION SHOWING MOUNTING

DIELECTRICALLY LOADED ANTENNA AND RADIO COMMUNICATION APPARATUS

CROSS REFERENCE TO RELATED APPLICATIONS

The present application claims the benefit of the filing date of U.S. Provisional Patent Application No. 61/313,222 filed on Mar. 12, 2010, the entire disclosure of which is hereby incorporated herein by reference.

FIELD OF THE INVENTION

This invention relates to a dielectrically loaded antenna for operation at a frequency in excess of 200 MHz and having an electrically insulative core of a solid material, and to radio communication apparatus incorporating a dielectrically loaded antenna.

BACKGROUND OF THE INVENTION

It is known to dielectrically load helical antennas for operation at UHF frequencies, particularly compact antennas for portable radio communication devices such as cellphones, satellite telephones, handheld positioning units and mobile positioning units. This invention is applicable in these and other fields such as WiFi, i.e., wireless local area network, devices, MIMO, i.e., multiple-input/multiple-output systems and other receiving and transmitting wireless systems Typically, such an antenna comprises a cylindrical ceramic core having a relative dielectric constant of at least 5, the outer surface of the core bearing an antenna element structure in the form of helical conductive tracks. In the case of a so-called "backfire" antenna, an axial feeder is housed in a bore extending through the core between proximal and distal transverse outer surface portions of the core, conductors of the feeder being coupled to the helical tracks via conductive surface connection elements on the distal transverse surface portion of the core. Such antennas are disclosed in Published British Patent Applications Nos. GB2292638, GB2309592, GB2399948, GB2441566, GB2445478, International Application No. WO2006/136809 and U.S. Published Application No. US2008-0174512A1. These published documents disclose antennas having one, two, three or four pairs of helical antenna elements or groups of helical antenna elements. WO2006/136809, GB2441566, GB2445478 and US2008-0174512A1 each disclose an antenna with an impedance matching network including a printed circuit laminate board secured to the distal outer surface portion of the core, the network forming part of the coupling between the feeder and the helical elements. In each case, the feeder is a coaxial transmission line, the outer shield conductor of which has connection tabs extending parallel to the axis through vias in the laminate board, the inner conductor similarly extending through a respective via. The antenna is assembled by, firstly, inserting the distal end portions of the coaxial feeder into the vias in the laminate board to form a unitary feeder structure, inserting the feeder, with the laminate board attached, into the passage in the core from the distal end of the passage so that the feeder emerges at the proximal end of the passage and the laminate board abuts the distal outer surface portion of the core. Next, a solder-coated washer or ferrule is placed around the proximal end portion of the feeder to form an annular bridge between the outer conductor of the feeder and a conductive coating on the proximal outer surface portion of the core. This assembly is then passed through an oven whereupon solder paste previously applied at predetermined locations on the proximal and distal faces of the laminate board, as well as the solder on the above-mentioned washer or ferrule, melts to form connections (a) between the feeder and the matching network, (b) between the matching network and the surface connection elements on the distal outer surface portion of the core, and (c) between the feeder and the conductive layer on the proximal outer surface portion of the core. Assembly and securing of the feeder structure of the core is, therefore, a three-step process, i.e., insertion, placing of the washer or ferrule, and heating. It is an object of this invention to provide an antenna which is simpler to assemble.

BRIEF SUMMARY OF THE INVENTION

According to a first aspect of the invention, there is provided a dielectrically loaded antenna for operation at a frequency in excess of 200 MHz, wherein the antenna comprises: an electrically insulative dielectric core of a solid material having a relative dielectric constant greater than 5 and having an outer surface including oppositely directed distal and proximal surface portions extending transversely of an axis of the antenna and a side surface portion extending between the transversely extending surface portions, the core outer surface defining an interior volume the major part of which is occupied by the solid material of the core; a three-dimensional antenna element structure including at least one pair of elongate conductive antenna elements disposed on or adjacent the side surface portion of the core and extending from the distal core surface portion towards the proximal core surface portion; a feed structure in the form of an axially extending elongate laminate board comprising at least a transmission line section acting as a feed line which extends through a passage in the core from the distal core surface portion to the proximal core surface portion, and an antenna connection section in the form of an integrally formed proximal extension of the transmission line section the width of which, in the plane of the laminate board, is greater than the width of the passage, and an impedance matching section coupling the antenna elements to the feed line. Use of an axially extending elongate laminate board as the feed structure has the advantage of comparative lack of rigidity compared with a coaxial feeder having a rigid metallic outer conductor. The increased width of the proximal extension of the transmission line section provides additional area for various connection elements, as will be described herein after. In particular, if required, specialist miniature connector assemblies can be dispensed with. The preferred laminate board has at least first, second and third conductive layers, the second layer being an intermediate layer between the first and third layers. In this way, it is possible to construct the feed line such that it has an elongate inner conductor formed by the second layer and outer shield conductors overlapping the inner conductor respectively above and below the latter and formed by the first and third layers respectively. The shield conductors may then be interconnected by interconnections located along lines running parallel to the inner conductor on opposite sides thereof, the interconnections preferably being formed by rows of conductive vias between the first and third layers. This has the effect of enclosing the inner conductor, the transmission line section thereby having the characteristics of a coaxial line.

In some embodiments of the invention, the axially extending laminate board carries an active circuit element on the proximal extension. Accordingly, an RF front-end circuit such as a low-noise amplifier may be mounted on the laminate board using, e.g., surface-mounting, input conductors of the element being coupled to the conductors of the feed line.

Alternatively, when the antenna is used for transmitting, the board may carry an RF power amplifier or, when used in a transceiver, both a power amplifier and a switch. It is also possible to incorporate further active circuit elements such as a GPS receiver chip or other RF receiver chip (even to the extent of a circuit with a low frequency (e.g., less than 30 MHz) or digital output), or a transceiver chip. In such embodiments in particular, the laminate board may have additional conductive layers. This allows the antenna to be connected to host equipment without using a specialist connector able to handle radio frequency signals. Dimensional limitations imposed by RF connections are also avoided in this case. The laminate board can, in this way, act as a single carrier for any circuit elements forming part of an antenna assembly supplied as a complete unit, e.g., the active circuit element or elements described above, matching components, and so on.

In one embodiment of the invention, however, the impedance matching section is carried on a second laminate board, conductors of which are coupled to the feed line. In this embodiment, the second laminate board is oriented perpendicularly to the axially extending laminate board and has an aperture therein to receive a distal end portion of the latter. The impedance matching section preferably includes at least one reactive matching element in the form of a shunt capacitor connected between the inner conductor and the shield conductors of the feed line at its distal end. The series inductance may be coupled between one of the conductors of the feed line and at least one of the elongate antenna elements. The capacitance is preferably a discrete surface-mounted capacitor whilst the inductance is formed as a conductive track between the capacitor and one of each pair of elongate antenna elements.

It is possible to use the preferred antenna as a dual-service antenna. Thus, in the case of a quadrifilar helical antenna in accordance with the invention, the antenna typically has not only a quadrifilar resonance producing an antenna radiation pattern for circularly polarized radiation, but also a quasi-monopole resonance for linearly polarized signals. The quadrifilar resonance produces a cardioid-shaped radiation pattern centered on the axis of the antenna and, therefore, is suitable for transmitting or receiving satellite signals, whereas the quasi-monopole resonance produces a toroidal radiation pattern symmetrical about the antenna axis and, therefore, is suited to transmission and reception of terrestrial linearly polarized signals. One preferred antenna having these characteristics has a quadrifilar resonance in a first frequency band associated with GNSS signals (e.g., 1575 MHz, the GPS-L1 frequency), and a quasi-monopole resonance in the 2.45 GHz ISM (industrial-scientific-medical) band used by Bluetooth and WiFi systems.

Where dual-service operation is contemplated, the impedance matching section may be a two-pole matching section comprising the series combination of two inductances between a first conductor or the feed line and one antenna element of each conductive antenna element pair and first and second shunt capacitances. The first shunt capacitance is connected as described above, i.e., between the first and second conductors of the feed line. The second shunt capacitance is connected between a link between the second conductor of the feed line and the other elongate conductive antenna element or elements on the one hand, and the junction between the first and second inductances on the other hand.

In the antenna described hereinafter, the use of an elongate laminate board for the feeder has the particular advantage, when dual-service operation of the antenna is required, that the outer shield conductors form part of the conductive loop or loops determining the frequency of the quasi-monopole resonance. In particular, the electrical length of the feed line shield conductors depends on, amongst other parameters, the width of the shield conductors. This means that the quasi-monopole resonant frequency can be selected substantially independently of the parameters affecting the quadrifilar resonance frequency, if required. Indeed, the antenna lends itself to a manufacturing process in which elongate laminate boards with shield conductors of different widths are provided, the process including the step of selecting, for each antenna, an elongate laminate board with shield conductors of a particular width according to the intended use of the antenna. The same selection step can be used to reduce resonant frequency variations occurring due to variations in the relevant dielectric constant between different batches of antenna cores manufactured from different batches of ceramic material.

It is preferred that the elongate laminate board is symmetrically placed within the passage through the antenna core. Thus, in the case of a passage of circular cross section, it is preferred that the laminate board is diametrically positioned. This aids symmetrical behavior of the shield conductors in the quasi-monopole mode of resonance. It should be noted that the passage through the core of the preferred antenna is not plated. It is also preferred that the inner conductor of the transmission line section is centrally positioned between the shield conductors to avoid asymmetrical field concentrations in the feed line. Lateral symmetry of the laminate board and conductor areas thereon is also preferred (i.e., symmetry in the planes of the laminate board conductive layers).

According to a second aspect of the invention, a dielectrically-loaded antenna for operation at a frequency in excess of 200 MHz comprises an electrically insulative dielectric core of a solid material having a relative dielectric constant greater than 5 and having an outer surface including oppositely directed distal and proximal surface portions extending transversely of an axis of the antenna and a side surface portion extending between the transversely extending surface portions, the core outer surface defining an interior volume the major part of which is occupied by the solid material of the core; a three-dimensional antenna element structure including at least one pair of elongate conductive antenna elements disposed on or adjacent the side surface portion of the core and extending from the distal core surface portion towards the proximal core surface portion; and an axially extending laminate board housed in a passage extending through the core from the distal core surface portion to the proximal core surface portion, which laminate board has first, second and third conductive layers, the second layer being sandwiched between the first and third layers, and includes a transmission line section acting as a feed line and an integral distal impedance matching section coupling the feed line to the antenna elements; wherein the second layer forms an elongate inner conductor of the feed line and the first and third layers form elongate shield conductors, the shield conductors being wider than the inner conductor and being interconnected along their elongate edge portions. Preferably, the antenna includes a trap element linking proximal ends of at least some of the elongate conductive elements and coupled to the feed line in the region of the proximal surface portion of the core. In the quasi-monopole resonant mode, currents flow in a second conductive loop formed between the conductors of the feed line by at least one of the elongate antenna elements, the trap element, and the outer surface or surfaces of the shield conductors of the feed line. The quasi-monopole resonance mode is a fundamental resonance, in this case, at a higher resonant frequency than the frequency of the quadrifilar resonance.

The preferred elongate laminate board has a substantially constant-width transmission line section, i.e., it is formed as a constant-width strip, and the passage through the core has a circular cross section the diameter of which is at least approximately equal to the width of the strip such that the edges of the strip are supported by the passage wall or in longitudinal diametrically-opposed grooves therein.

According to a third aspect of the invention, there is provided radio communication apparatus comprising an antenna and, connected to the antenna, radio communication circuit means operable in at least two radio frequency bands above 200 MHz, wherein the antenna comprises an electrically insulative dielectric core of a solid material having a relative dielectric constant greater than 5 and having an outer surface including oppositely directed distal and proximal surface portions extending transversely of an axis of the antenna and a side surface portion extending between the distal and proximal surface portions, a feeder structure which passes through the core substantially from the distal surface portion to the proximal surface portion, and, located on or adjacent the outer surface of the core, the series combination of a plurality of elongate conductive antenna elements and a conductive trap element which has a grounding connection to the feeder structure in the region of the core proximal surface portion, the antenna elements being coupled to a feed connection of the feeder structure in the region of the core distal surface portion, wherein the radio communication circuit means have two parts operable respectively in a first and a second of the radio frequency bands and each associated with respective signal lines for conveying signals flowing between a common signal line of the antenna feeder structure and the respective circuit means part, wherein the antenna is resonant in a first, circular polarization mode of resonance in the first frequency band and in a second, linear polarization mode of resonance in the second frequency band, which second frequency band lies above the first frequency band, the first and second modes of resonance being fundamental modes of resonance. The radio communication circuit means may be operable at further circular polarization and linear polarization modes of resonance of the antenna.

The first and second frequency bands have respective center frequencies, that of the second frequency band preferably being higher than the first center frequency but lower than twice the first center frequency.

According to a fourth aspect of the invention, there is provided an antenna for operation at a frequency in excess of 200 MHz comprising: an electrically insulative dielectric core of a solid material having a relative dielectric constant greater than 5 and having an outer surface including oppositely directed distal and proximal surface portions extending transversely of an axis of the antenna and a side surface portion extending between the transversely extending surface portions, the core outer surface defining an interior volume the major part of which is occupied by the solid material of the core; a three-dimensional antenna element structure including at least one pair of elongate conductive antenna elements disposed on or adjacent the side surface portion of the core and extending from the distal core surface portion towards the proximal core surface portion; and an axially extending laminate board housed in a passage extending through the core from the distal core surface portion to the proximal core surface portion, which laminate board has at least a first layer and includes a transmission line section acting as a feed line and feed connection elements for coupling the feed line to the antenna elements, the transmission line section including at least first and second feed line conductors; wherein the laminate board further comprises a proximal extension of the transmission line section carrying on one face an active circuit element coupled to the feed line conductors, the other face of the proximal extension have a ground plane which is electrically connected to one of the feed line conductors.

According to a fifth aspect of the invention, a dielectrically loaded antenna for operation at a frequency in excess of 500 MHz comprises: an electrically insulative dielectric core of a solid material having a relative dielectric constant greater than 5 and having an outer surface including oppositely directed distal and proximal surface portions extending transversely of an axis of the antenna and a side surface portion extending between the transversely extending surface portions, the core outer surface defining an interior volume, the major part of which is occupied by the solid material of the core; a three-dimensional antenna element structure including at least one pair of elongate conductive antenna elements disposed on or adjacent the side surface portion of the core and extending from the distal core surface portion towards the proximal core surface portion; a feed structure in the form of an axially extending elongate laminate board comprising at least a transmission line section acting as a feed line which extends through a passage in the core from the distal core surface portion to the proximal core surface portion; and a plurality of spring contacts located proximally of the antenna core which are electrically connected to the feed line and which are constructed and arranged for bearing resiliently against contact areas formed as a conductive layer or layers of an equipment laminate circuit board when the latter is located adjacent the antenna in a preselected position. The spring contacts are preferably metal leaf springs shaped to deform resiliently in response to a compression force directed axially of the antenna. Such resilient deformation may occur when the antenna is brought into juxtaposition with an equipment circuit board, the plane of which lies perpendicular to the antenna axis. Base plating on the proximal surface portion of the core of the preferred antenna provides a metallic fixing base for the spring contacts, e.g., by soldering.

Alternatively, the metal leaf spring contacts may be shaped to deform in response to a compression force directed transversely with respect to the antenna axis, e.g., when the antenna is brought into juxtaposition with an equipment circuit board the plane of which lies parallel to the antenna axis.

The spring contacts, when soldered to the base conductors on the elongate laminate board, are connected to the feed line conductors. It is preferred that there are three such spring contacts arranged side-by-side on one surface of the laminate board proximal extension, the middle contact being connected to the inner conductor of the feed line, and the first and third contacts being connected to the shield conductors of the feed line.

Each spring contact is preferably in the form of a folded metal spring element shaped to as to have a fixing leg for fixing to a conductive base on the laminate board, and a contacting leg for engaging contact areas on an equipment circuit board to which the antenna is to be connected. The resilience of the material of the spring element allows resilient deformation by relative approaching movement of the two legs of the element in response to application of a force urging the contacting leg towards the fixing leg.

The invention also provides a radio communication unit comprising an equipment circuit board, an antenna as described above, and a housing for the circuit board and the antenna. The unit is arranged such that when the antenna and the circuit board are installed in the housing, the spring contacts bear resiliently against contact areas formed as a conductive layer or layers of the equipment circuit board to connect the antenna to the equipment circuit board. The housing is preferably in two parts and has a receptacle for the antenna, which receptacle is shaped to locate the antenna at least axially.

According to another aspect of the invention, there is provided a method of assembling the above radio communication unit, wherein the apparatus further comprises a two-part housing for the antenna and the equipment circuit board, the housing having a receptacle shaped to receive the antenna and to locate it in a pre-selected position with respect to the circuit board, in which position the spring contacts are in registry with and bear against respective contact areas on the equipment circuit board, wherein the method comprises securing the circuit board in the housing, placing the antenna in the receptacle, and bringing the two parts of the housing together in an assembled condition, the action of bringing the two parts together urging the spring contacts against the respective contact areas on the equipment circuit board, thereby compressively deforming the spring contacts. It is preferred that the two parts of the housing are snapped together.

According to yet another aspect of the invention, radio communication apparatus comprises: (a) a backfire dielectrically loaded antenna for operation at a frequency in excess of 200 MHz comprising: an electrically insulative dielectric core of a solid material having a relative dielectric constant greater than 5 and having an outer surface including oppositely directed distal and proximal surface portions extending transversely of an axis of the antenna and a side surface portion extending between the transversely extending surface portions, the core outer surface defining an interior volume the major part of which is occupied by the solid material of the core; a three-dimensional antenna element structure including at least one pair of elongate conductive antenna elements disposed on or adjacent the side surface portion of the core and extending from the distal core surface portion towards the proximal core surface portion; a feed structure in the form of an axially extending elongate laminate board comprising at least a transmission line section acting as a feed line which extends through a passage in the core from the distal core surface portion to the proximal core surface portion, the antenna having exposed contact areas on or adjacent the core proximal surface portion; and (b) radio communication circuit means having an equipment laminate circuit board with at least one conductive layer, the conductive layer or layers having a plurality of contact terminal support areas to each of which is conductively bonded a respective spring contact positioned so as to bear resiliently against respective ones of the exposed contact areas of the antenna. In one embodiment, the exposed contact areas of the antenna lie parallel to the plane of the equipment laminate circuit board, each spring contact being shaped to exert an engagement force acting perpendicularly to the plane of the equipment board. In another embodiment, the exposed contact areas of the antenna lie perpendicularly with respect to the antenna axis. In this case, the spring contacts may be shaped to deform resiliently in response to a compression force directed generally axially of the antenna, whether the antenna is turret-mounted or edge-mounted or edge-mounted with respect to the equipment circuit board.

One option for connection of the antenna to the equipment circuit board using resilient spring contacts is to provide the proximal end surface portion of the antenna core with a conductive layer which is patterned such that an isolated conductor land is provided, i.e., insulated from the remainder of the proximal conductive layer forming part of the trap or balun. This land, and the remainder of the conductive layer may be used, respectively, as a conductor base for attaching respective folded resilient contacts, or as the base for conductive plates forming contact areas engaging spring contacts on the equipment circuit board. In the case of the spring contact being fixed to the proximal conductive layer of the antenna, such contacts may, additionally, provide a resilient non-soldered connection to contact areas on the elongate laminate board, especially to contact areas on opposite faces of the proximal extension of the transmission line section. This avoids the need for soldered connections between the laminate board and the equipment circuit board in the case of turret-mounting of the antenna or other connection configurations in which the spring contacts exert a contact bearing force acting axially of the antenna.

As in the case of the spring contacts being mounted on the antenna, there are preferably three spring contacts mounted side-by-side on the equipment circuit board to engage three correspondingly spaced contact areas on one face of the proximal extension of the antenna elongate laminate board.

According to another aspect, the invention provides a backfire dielectrically loaded antenna for operation at a frequency in excess of 200 MHz comprising: an electrically insulative dielectric core of a solid material having a relative dielectric constant greater than 5 and having an outer surface including oppositely directed distal and proximal surface portions extending transversely of an axis of the antenna and a side surface portion extending between the transversely extending surface portions, the core outer surface defining an interior volume, the major part of which is occupied by the solid material of the core; a three-dimensional antenna element structure including at least one pair of elongate conductive antenna elements disposed on or adjacent the side surface portion of the core and extending from the distal core surface portion towards the proximal core surface portion; and a feed structure comprising first and second feed conductors which extend axially through a passage in the core from the distal core surface portion to the proximal core surface portion; wherein the proximal core surface portion has a conductive coating patterned to form at least two conductive areas electrically separated from each other, and wherein the antenna further comprises electrical connections, at the proximal end of the passage, between each feed conductor and a respective one of the conductive areas on the proximal core surface portion, the arrangement thereby providing at least a pair of planar contact surfaces on the proximal core surface portion for mounting the antenna on a host equipment board with the axis of the antenna perpendicular to the equipment board.

According to a further method aspect, the invention provides a method of assembling radio communication apparatus of any preceding claim, the apparatus further comprising a two-part housing for the antenna and the equipment circuit board, the housing having a receptacle shaped to receive the antenna and to locate it in a preselected position with respect to the circuit board, in which position the spring contacts are in registry with and bear against the respective contact areas of the antenna, wherein the method comprises securing the circuit board in the housing, placing the antenna in the receptacle, and bringing the two parts of the housing together in an assembled condition, the action of bringing the two parts together urging the spring contacts against the respective contact areas on the antenna thereby compressively deforming the spring contacts.

BRIEF DESCRIPTION OF THE DRAWINGS

The invention will now be described by way of example with reference to the drawings in which:—

DETAILED DESCRIPTION OF THE DRAWINGS

Figures 1A, 1B:
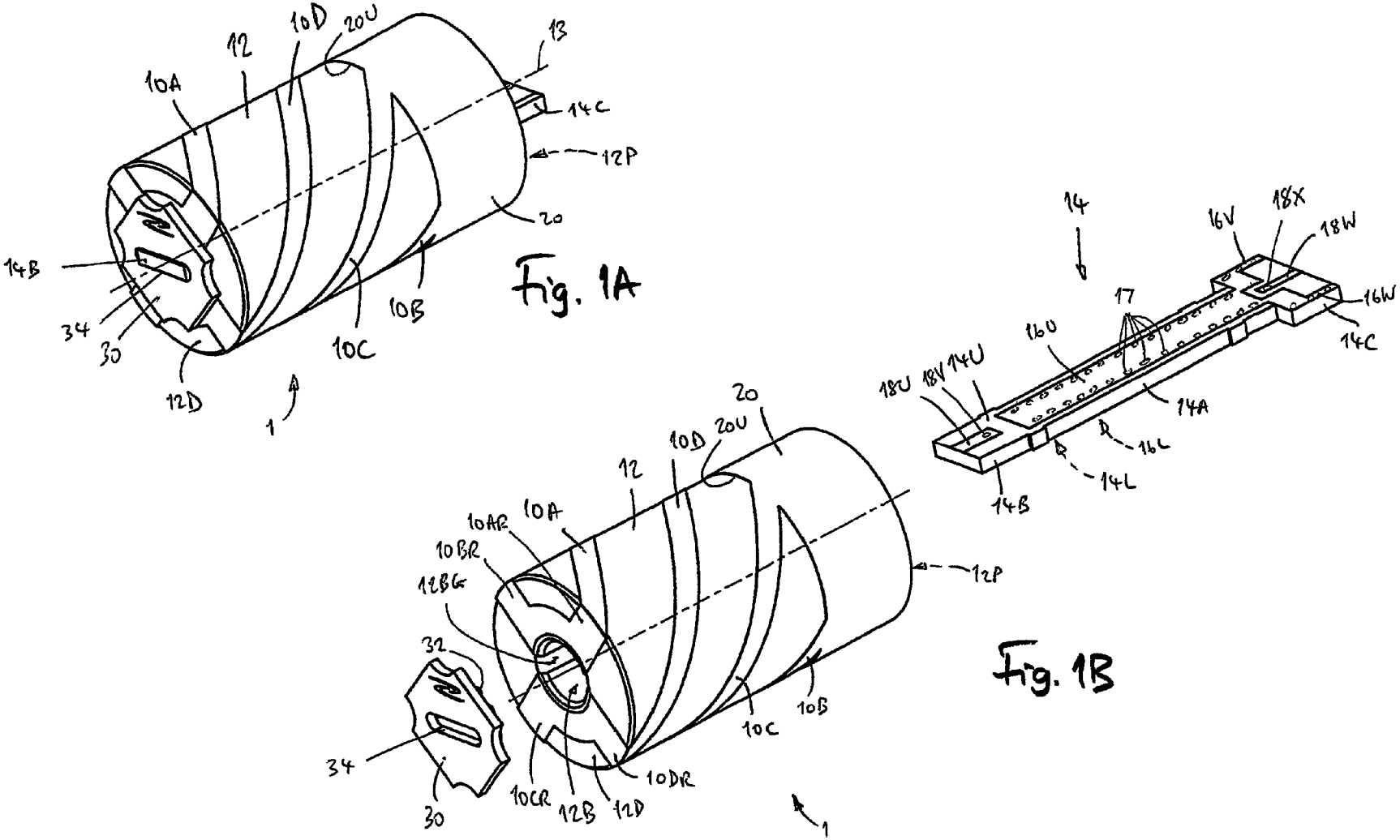
FIGS. 1A and 1B are respectively perspective assembled and exploded views of a first antenna.

Referring to FIGS. 1A and 1B, an antenna in accordance with a first aspect of the invention has an antenna element structure with four axially coextensive helical tracks 10A, 10B, 10C, 10D plated or otherwise metallized on the cylindrical outer surface of a cylindrical ceramic core 12. The relative dielectric constant of the ceramic material of the core is typically greater than 20. A barium-samarium-titanate-based material, having a relative dielectric constant of 80 is especially suitable.

The core 12 has an axial passage in the form of a bore 12B extending through the core from a distal end surface portion 12D to a proximal end surface portion 12P. Both of these surface portions are planar faces extending transversely and perpendicularly with respect to the central axis 13 of the core. They are oppositely directed, in that one is directed distally and the other proximally. Housed within the bore 12B is a feeder structure in the form of an elongate laminate board 14 having a transmission line section 14A, a matching network connection section 14B and an antenna connection section 14C in the form of integrally formed distal and proximal extensions, respectively, of the transmission line section.

The laminate board 14 has three conductive layers, only one of which appears in FIG. 1B. This first conductive layer is exposed on an upper surface 14U of the board 14. A third conductive layer is similarly exposed on a lower surface 14L of the laminate board 14, and a second, intermediate conductive layer is embedded in insulating material of the laminate board 14, midway between the first and third conductive layers. In the transmission line section 14A of the laminate board 14, the second, middle, conductive layer is in the form of a narrow elongate track extending centrally along the transmission line section 14A to form an inner feed conductor (not shown). Overlying and underlying the inner conductor are wider elongate conductive tracks formed respectively by the first and third conductive layers. These wider tracks constitute upper and lower shield conductors 16U, 16L shielding the inner conductor.

The shield conductors 16U, 16L are interconnected by plated vias 17 located along lines running parallel to the inner conductor on opposite sides thereof, the vias being spaced from the longitudinal edges of the inner conductor in order that they are spaced from the latter by the insulating material of the laminate board 14. It will be understood that the combination of the elongate tracks formed by the three conductive layers in the transmission line section 14A, and the interconnecting vias 17, form a coaxial feed line having an inner conductor and an outer shield, the latter constituted by the upper and lower conductive tracks 16U, 16L and the vias 17. Typically, the characteristic impedance of this coaxial feed line is 50 ohms.

In the distal extension 14B of the laminate board 14, the inner conductor (not shown) is coupled to an exposed upper conductor 18U by an inner conductor distal via 18V. Similarly, there is an exposed connecting conductor 18L (not shown in FIG. 1B) on the lower surface of the distal extension 14B, which conductor is an extension of the lower shield conductor 16L.

In the proximal extension 14C of the laminate board 14, the inner conductor (not shown) is connected to an exposed central contact area 18W on the upper surface 14U of the laminate board 14, this contact area 18W being connected to the inner conductor by a proximal via 18X. On the same upper laminate board layer 14U there are two outer exposed contact areas 16V, 16W, arranged on opposite sides of the central contact area 18W. Together, these three side-by-side contact areas constitute a set of contacts for connecting the assembled antenna to, e.g., spring contacts on an equipment motherboard as will be described hereinafter.

It will be noted that the antenna connection section 14C of the laminate board 14 is rectangular in shape, the width of the rectangle being greater than that of the parallel-sided transmission line section 14A so that when, during assembly, the laminate board 14 is inserted in the core 12 of the antenna 1 from the proximal end, the antenna connection section 14C abuts the proximal end surface portion 12P of the antenna core 12 so that the antenna connection section is proximally exposed.

The length of the laminate board 14 is such that, when the antenna connection section abuts the proximal end surface portion 12P, the matching network connection section 14B projects by a short distance from the bore 12B at its distal end. The width of the transmission line section corresponds generally to the diameter of the bore 12B (which is circular in cross section) so that the outer shield conductors 16U, 16L are spaced from the ceramic material of the core 12. (Note that the bore 12B is not plated.) Accordingly, there is minimal dielectric loading of the shield conductors 16U, 16L by the ceramic material of the core 12. The relative dielectric constant of the insulating material of the laminate board is about 4.5 in this embodiment.

Angular location of the laminate board 14 is aided by longitudinal grooves 12BG in the bore 12B, as shown in FIG. 1B.

Plated on the proximal end surface portion 12P of the core are surface connection elements formed as radial tracks 10AR, 10BR, 10CR, 10DR. Each surface connection element extends from a distal end of the respective helical track 10A-10D to a location adjacent the end of the bore 12B. It will be seen that the radial tracks 10AR-10DR are interconnected by arcuate conductive links so that the four helical tracks 10A-10D are interconnected as pairs at their distal ends.

The proximal ends of the antenna elements 10A-10D are connected to a common virtual ground conductor in the form of a plated sleeve 20 surrounding a proximal end portion of the core 12. This sleeve 20 extends to a conductive coating (not shown) of the proximal end surface portion 12P of the core.

Overlying the distal end surface portion 12D of the core 12 is a second laminate board 30 in the form of an approximately square tile centrally located with respect to the axis 13. Its transverse extent is such that it overlies the inner ends of the radial tracks 10AR, 10BR, 10CR, 10DR and their respective arcuate interconnections. The second laminate board 30 has a single conductive layer on its underside, i.e., the face that faces the distal end surface portion 12D of the core. This conductive layer provides feed connections and antenna element connections for coupling the conductive layers 16U, 16L, 18 of the transmission line section 14A to the antenna elements 10A-10D via the conductive surface connection elements 10AR-10DR on the core surface portion 12D. The laminate board conductive layer also constitutes, in conjunction with a surface mounted capacitor on its underside (not shown), an impedance matching network for matching the impedance presented by the antenna element structure to the characteristic impedance (50 ohms) of the transmission line section 14A.

Figure 1C:
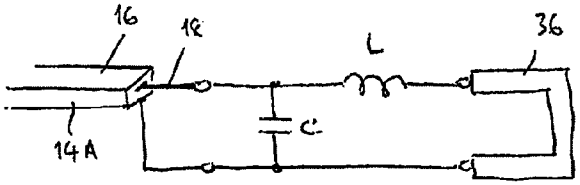
FIGS. 1C and 1D are circuit diagrams of single-pole and two-pole matching networks, respectively, for the antenna of FIGS. 1A and 1B.

The circuit diagram of the impedance matching network is shown in FIG. 1C. As shown in FIG. 1C, the impedance matching network has a shunt capacitance C connected across the conductors 16, 18 of the feed line, and a series inductance between one of the feed line conductors 18 and the radiating elements 10A-10D of the antenna, represented by the load or source 36, the other conductor 16 of the feed line being directly connected to the other side of the load/source 36. In this respect, the interconnection of the feed line to the antenna elements 10A-10B is electrically the same as disclosed in WO2006/136809, the contents of which are incorporated herein by reference. Connections between the second laminate board 30 and the conductors on the proximal end surface portion 12D of the core are made by a ball grid array 32, as described in our co-pending British Patent Application No. 0914440.3, the contents of which are also incorporated herein by reference.

The second laminate board 30 has a central slot 34 which receives the projecting matching network connection section 14B of the elongate laminate board 14, as shown in FIG. 1A, solder connections being made between the conductive areas, including the upper conductive area 18U on the laminate board 14 and conductors of the conductive layer (not shown) on the underside of the second laminate board 30.

In the assembled antenna, the proximal extension 14C of the laminate board 14 abuts the plated proximal end surface portion 12P of the core and, during assembly of the antenna, the first and third exposed contact areas 16V, 16W (see FIG. 1B) are electrically connected to the plated surface portion 12P.

The above-described components and their interconnections yield a dielectrically-loaded quadrifilar helical antenna which is electrically similar to the quadrifilar antennas disclosed in the above-mentioned prior patent publications. Thus, the conductive sleeve 20 and the plated layer (not shown) on the proximal end surface portion 12P of the core 12, together with the feed line shield formed by the shield conductors 16U, 16L, form a quarter-wave balun providing common-mode isolation of the antenna element structure 10A-10D from equipment to which the antenna is connected when installed. The metallized conductor elements formed by the antenna elements 10A-10D and other metallized layers on the core define an anterior volume the major part of which is occupied by the dielectric material of the core.

The antenna has a circular polarization resonant mode, in this case, at 1575 MHz, the GPS L1 frequency.

In this circular polarization resonant mode, the quarter-wave balun acts as a trap preventing the flow of currents from the antenna elements 10A-10D to the shield conductors 16U, 16L at the proximal end surface portion 12P of the core so that the antenna elements, the rim 20U of the sleeve 20, and the radial tracks 10AR-10DR form conductive loops defining the resonant frequency. Accordingly, in the circular polarization resonance mode, currents flow from one of the feed line conductors back to the other feed line conductor via, e.g., a first helical antenna element 10A, around the rim 20U of the sleeve 20 to the oppositely located helical antenna element 10C, and back up this latter element 10C.

The antenna also exhibits a linear polarization resonance mode. In this mode, currents flow in different conductive loops interconnecting the feed line conductors. More specifically, in this case, there are four conductive loops each comprising, in order, one of the radial tracks 10AR-10DR, the associated helical antenna element 10A-10D, the sleeve 20 (in a direction parallel to the axis 13), the plating on the proximal end surface portion 12P and the outer surfaces of the feed line shield formed by the shield conductors 16U, 16L and their interconnecting vias 17. (It will be noted that currents flowing in the feed line formed by the transmission line section 14A flow on the inside of the shield formed by the shield conductors 16U, 16L.) The length of the feed line and, therefore, the lengths of the shield conductors, their widths, and their proximity to the ceramic material of the core 12 determine the frequency of this linear polarization resonance.

Owing to the comparatively slight dielectric loading of the shield conductors 16U, 16L by the ceramic material of the core 12, the electrical length of the conductive loops in this case is less than the average electrical length of the conductive loops which are active in the circular polarization resonance mode. Accordingly, the linear polarization resonance mode is centered on a higher frequency than the circular polarization resonance mode. The linear polarization resonance mode had an associated radiation pattern which is toroidal, i.e., centered on the axis 13 of the antenna. It is, therefore, especially suitable for receiving terrestrial vertically polarized signals when the antenna is oriented with its axis 13 substantially vertical.

Adjustment of the resonant frequency of the linear polarization mode can be effected substantially independently of the resonant frequency of the circular polarization mode by altering the widths of the shield conductor tracks 16U, 16L. In this example, the resonant frequency of the linear polarization mode is 2.45 GHz (i.e., in the ISM band).

Figure 1D:
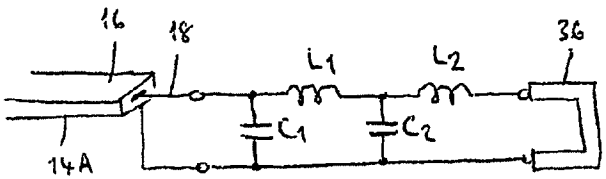

When dual-frequency operation is required, it is preferred that the matching network is a two-pole network, as shown in FIG. 1D.

Figure 2:
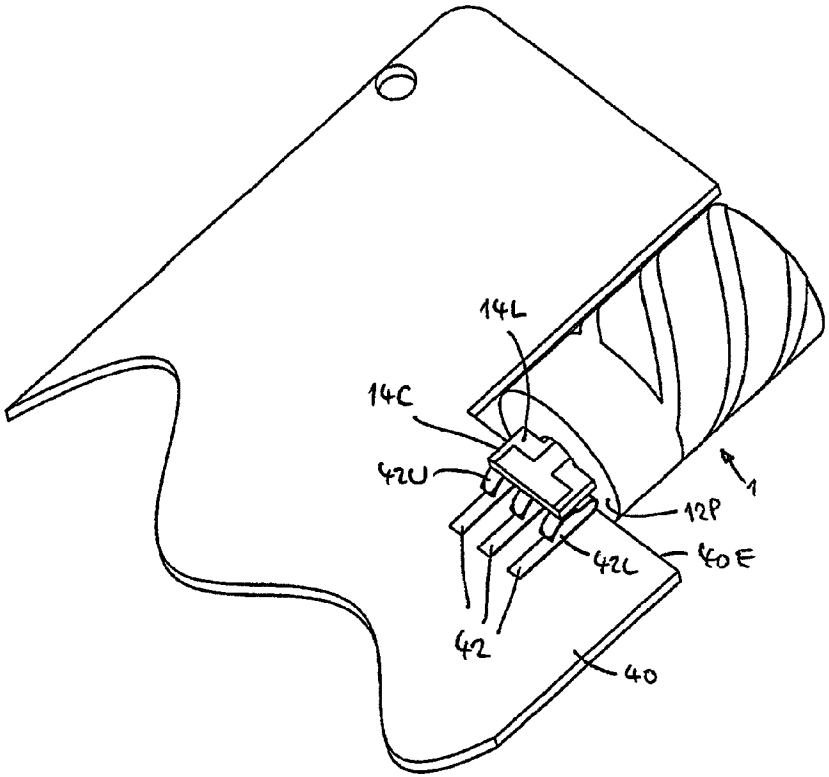
FIG. 2 is a perspective view of part of a radio communication unit including the antenna of FIGS. 1A and 1B.

The construction of the feeder structure as an elongate laminate board affords a particularly economical connection of the antenna to host equipment. Referring to FIG. 2, in a case where the antenna 1 is to be connected to circuit elements on an equipment circuit board 40, a direct electrical connection between the antenna feed line and the circuit board 40, which is oriented with its plane parallel to the antenna axis, may be achieved by conductively mounting metallic spring contacts 42 side-by-side adjacent an edge 40E of the circuit board and spaced according to the spacing of the contact areas 16V, 18W and 16W on the antenna connection section 14C of the elongate antenna laminate board 14 (FIG. 1B). The spring contacts 42 are positioned according to the position of the antenna connection section 14C of the antenna when the antenna is mounted in a required position relative to the circuit board 40.

Each spring contact comprises a metallic leaf spring having a folded configuration with a fixing leg 42L secured to a respective conductor (not shown) on the circuit board 40 and a contacting leg 42U extending over the fixing leg 42L but spaced therefrom so that when a force perpendicular to the plane of the board 40 is applied to the contacting leg 42U, it approaches the fixing leg 42L. It will be understood, therefore, that when the antenna 1 is brought into juxtaposition with the circuit board 40, as shown, with the contact areas 16V, 18W, 16W (FIG. 1B) in registry with the spring contacts 42, the spring contacts are resiliently deformed and bear against their respective contact areas 16V, 18W, 16W to make an electrical connection between the antenna 1 and the circuit elements of the circuit board 40.

It will be noted that there is no separate connector device between the antenna and the circuitry of the circuit board 40. Rather, each spring contact 42 is individually and separately applied to the circuit board 40 in the same manner as other surface-mounted components.

Figure 3A:
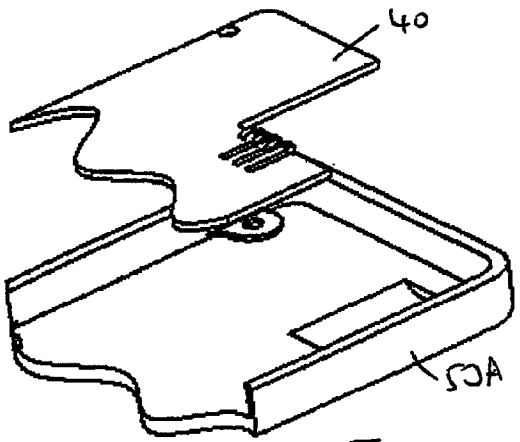
FIGS. 3A to 3F are diagrammatic perspective views of the radio communication unit of FIG. 2, showing a series of assembly steps.
Figure 3B:
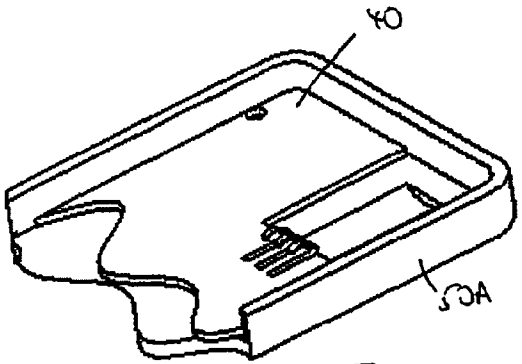
Figure 3C:
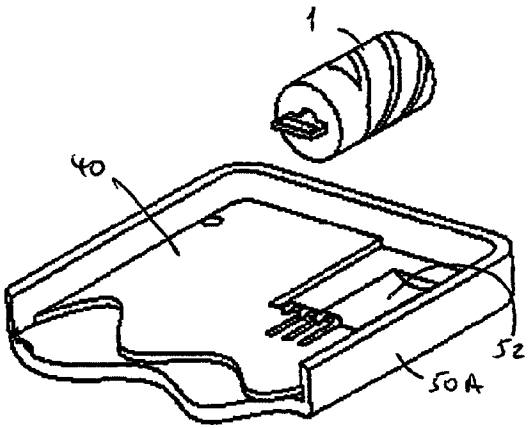
Figure 3D:
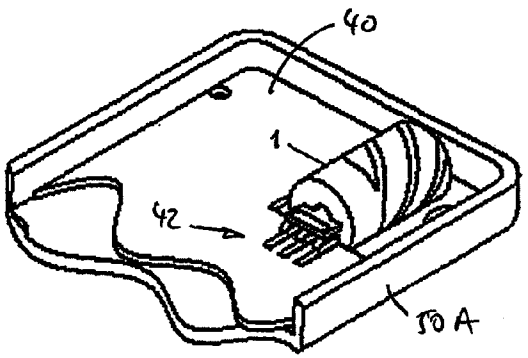
Figure 3E:
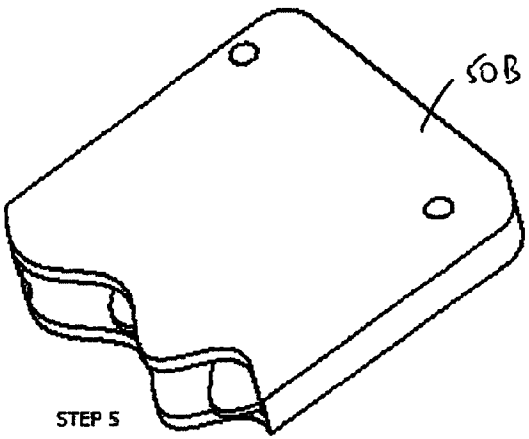

This configuration lends itself to a simple equipment assembly process, as shown in FIGS. 3A to 3F. Referring to FIGS. 3A to 3F, a typical assembly process comprises, firstly, placement of the circuit board 40 in a first equipment housing part 50A (FIGS. 3A and 3B). Secondly, the antenna 1 is introduced into a shaped antenna receptacle 52 in the housing part 50A (FIGS. 3C and 3D), the antenna connection section of the antenna elongate board 14 bearing against the spring contacts 42 on the circuit board 40, as shown particularly in FIG. 3D. Next, a second housing part 50B, which also has an internal surface shaped to engage the antenna 1, is brought into registry with the first-mentioned housing part 50A, causing the antenna 1 to be urged fully into the receptacle 52 in the housing part 50A, the spring contacts 42 being deformed in this housing closure step (FIG. 3E). The two housing parts 50A, 50B have snap features so that the final closing movement is associated with the snapping together of the two housing parts.

Figure 3F:
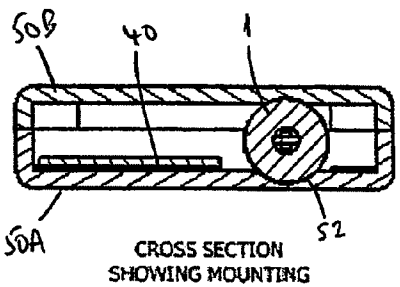

The support and location of the antenna 1 by the two housing parts 50A, 50B is shown in the cross section of FIG. 3F. The receptacle 52 and, if required, an oppositely directed receptacle in the housing cover part 50B, are shaped to locate the antenna not only transversely of the antenna axis but also in the axial direction. It will also be noted that, as well as providing a simple and inexpensive assembly process, the configuration of the interconnection between the antenna and the circuit board allows axial movement between the antenna and the board 40 without breaking the connections made by the spring contacts 42. This has the advantage that, should the equipment suffer severe shock (e.g., as in the case of a hand-held radio communication unit being dropped), the lack of a rigid connection between the antenna 1 and the circuit board 40 avoids strain on solder joints, e.g., the solder joints between the elongate laminate board 14 of the antenna and the second laminate board 30 of the antenna bearing the matching network (see FIGS. 1A and 1B), and between the transversely mounted laminate board 30 and the plated conductors on the distal end surface portion 12D of the antenna core.

Figures 4A, 4B:
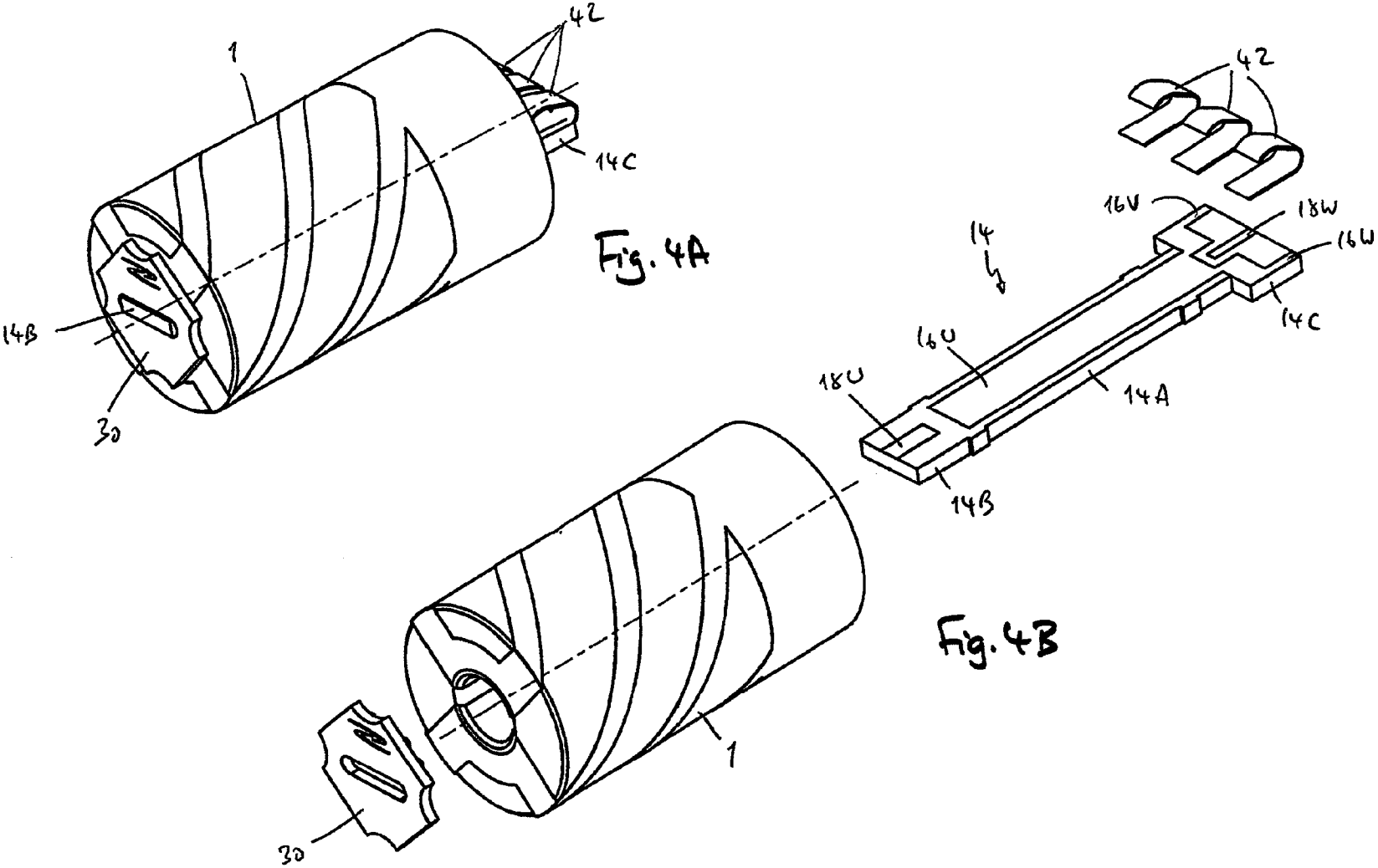
FIGS. 4A and 4B are, respectively, perspective assembled and exploded views of a second antenna.

Referring now to FIGS. 4A and 4B, a second antenna in accordance with the invention has spring contacts 42 mounted on the proximally projecting antenna connection section 14C of the elongate laminate board 14. As in the system described above with reference to FIG. 2, the spring contacts are metallic leaf springs each with a fixing leg and a contacting leg. In this case, the fixing legs are soldered individually and separately to the respective contact areas 16V, 18W, 16W of the antenna connection section 14C. The equipment circuit board (not shown) is provided with correspondingly spaced contact areas so that when the antenna 1 is pressed into its required position relative to the circuit board, the spring contacts 42 are compressed. This configuration yields the same advantages as those outlines above in respect of the unit of FIG. 2.

Figures 5A, 5B:
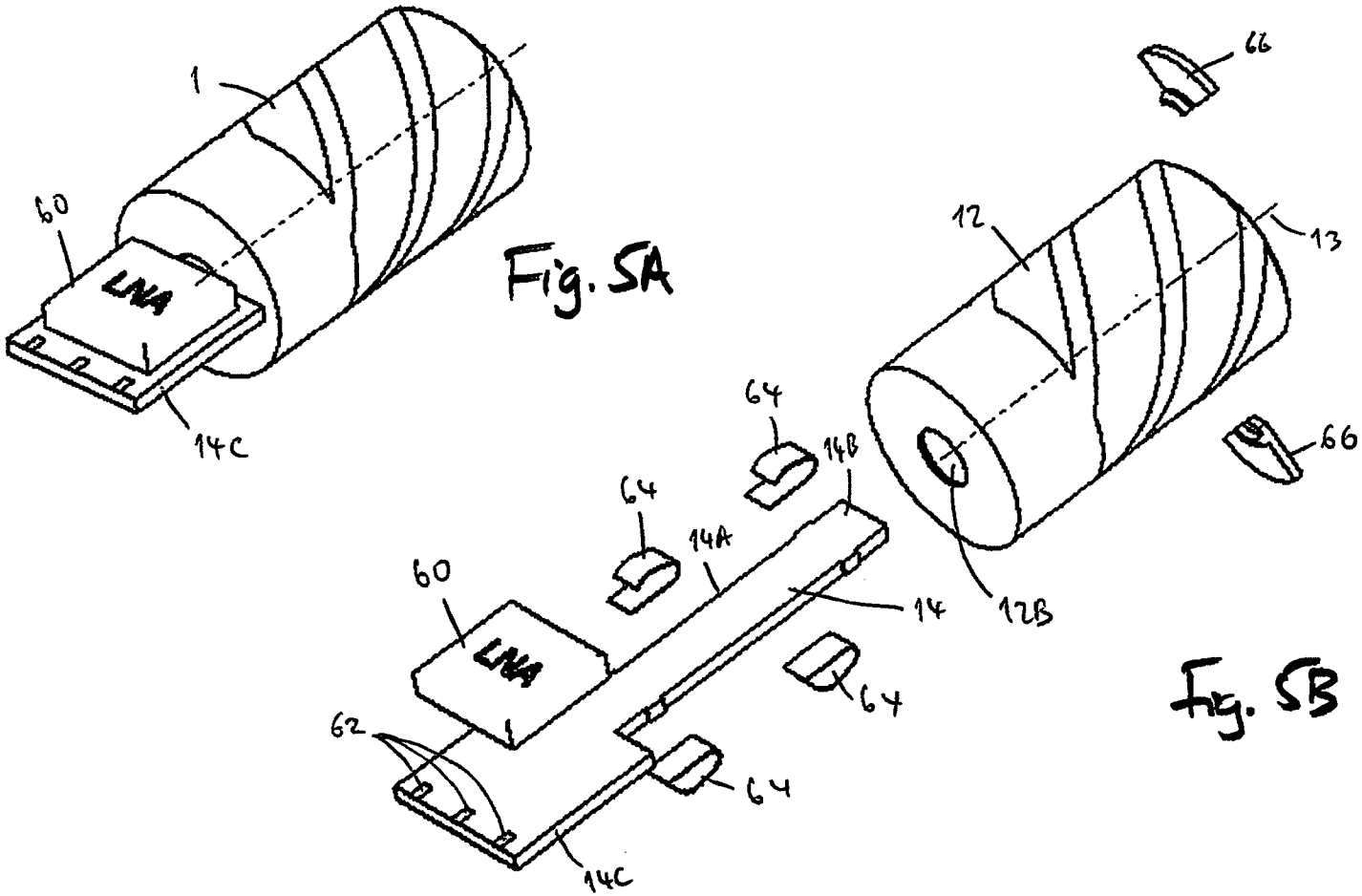
FIGS. 5A and 5B are, respectively, perspective assembled and exploded views of a first antenna assembly.

Referring to FIGS. 5A and 5B, the laminate board construction of the feed line also offers the possibility of an integral support for an active circuit element such as an RF front end low-noise amplifier 60. In this case, the laminate board 14 has a larger proximal extension 14C, the feed line conductors (not shown) of the transmission line section 14A being directly connected to inputs of the low-noise amplifier 60. The outputs of the amplifier may be coupled directly to exposed contact areas 62, as shown in FIGS. 5A and 5B, for connection to an equipment circuit board using spring contacts as described above with reference to FIG. 2. Location of the laminate board 14 within the bore 12B of the antenna core 12 (see FIG. 5B) is aided by spring biasing elements 64 on opposite faces of the laminate board 14. These bear against the walls of the bore 12B to help in centering the board 14 on the axis 13. In this case, direct connection of the feed line conductors of the feed line to the radial tracks on the proximal end surface portion 12P (not shown) may be completed by planar conductive ears or contact plates 66 which abut distal contact areas on the distal extension 14B of the laminate board 14 and which are soldered to the radial tracks.

Figures 6A, 6B:
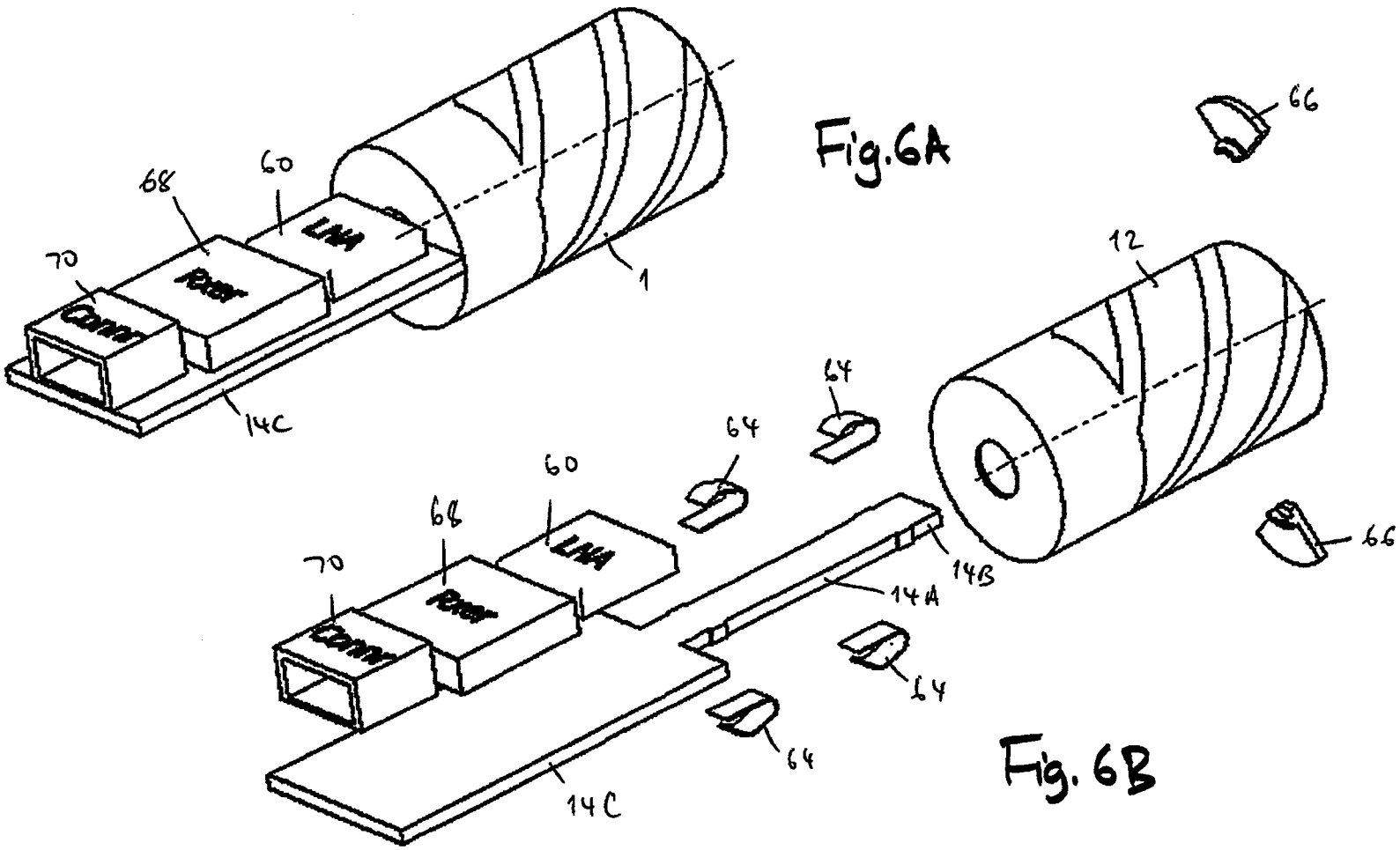
FIGS. 6A and 6B are, respectively, perspective assembled and exploded views of a second antenna assembly.

A further enlargement of the laminate board 14, as shown in FIGS. 6A and 6B allows an antenna assembly in which the feed line directly feeds a low noise amplifier 60 which, in turn, feeds a receiver chip 68, also mounted on the proximal extension 14B of the laminate board 14. This economical assembly has the potential advantage of eliminating high frequency currents at the connection between the laminate board 14 and equipment circuit board, whether that connection is made by a discrete connector 70, as shown in FIGS. 6A and 6B, a flexible printed circuit laminate, or by the spring contact arrangement described above with reference to FIG. 2. Additionally, having all of this circuitry on a common, continuous ground plane on the laminate board 14 reduces the chance of common-mode noise coupling into the circuitry on the laminate board 14 from noise-emitting circuitry on the equipment circuit board.

Figure 7B:
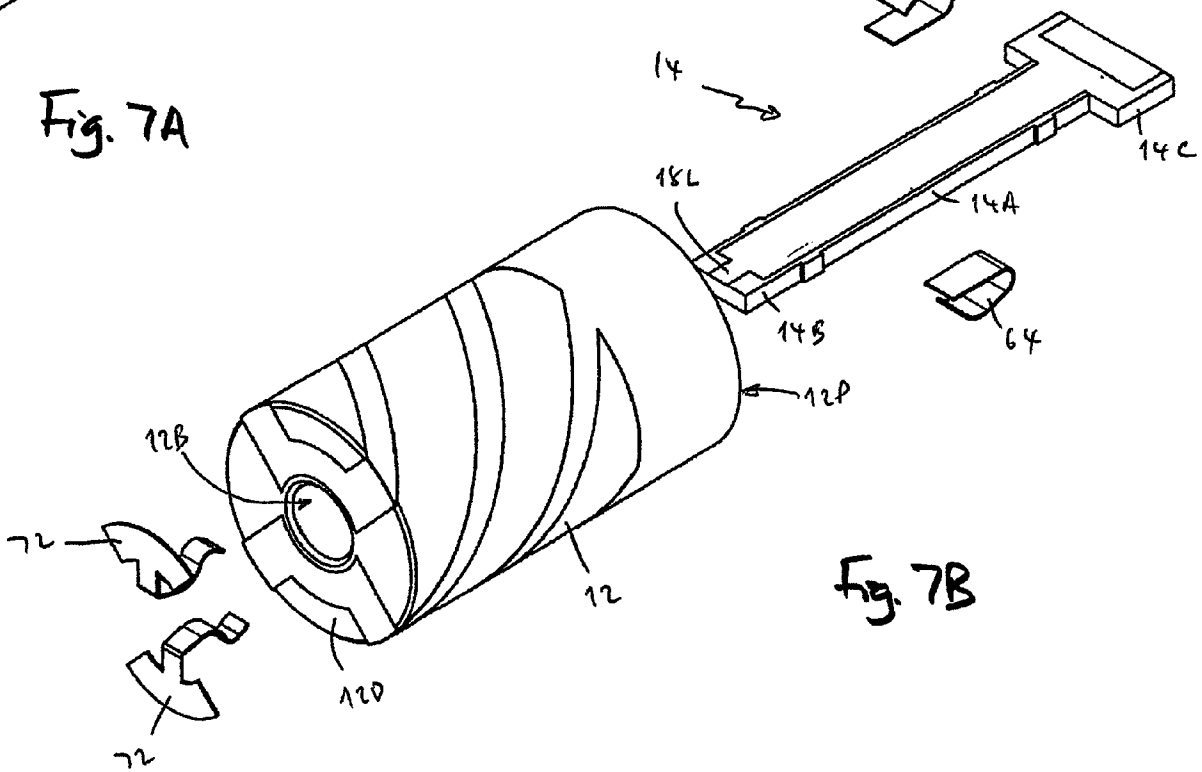
FIGS. 7A and 7B are, respectively, perspective assembled and exploded views of a third antenna.
Figure 7A:
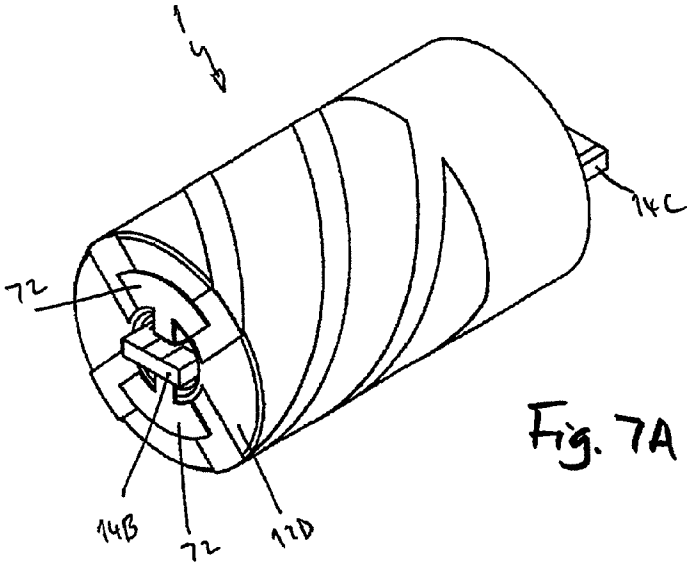

As an alternative to the conductive ears 66 described above with reference to FIG. 5B as a means of connecting the feed line conductors to the radial tracks on the distal end surface 12P of the core, spring contacts may be used, as shown in FIGS. 7A and 7B. These spring contacts each have a planar connection base for soldering to the conductive layer on the distal end face 12D and a depending jogged spring section which penetrates the bore 12B on opposite sides of the elongate laminate board 14 to contact distal contact areas on the distal extension 14B of the transmission line section 14A. This afford shock-resistant interconnection of the feed line 14 and the antenna elements 10A-10B.

Figures 8A, 8B:
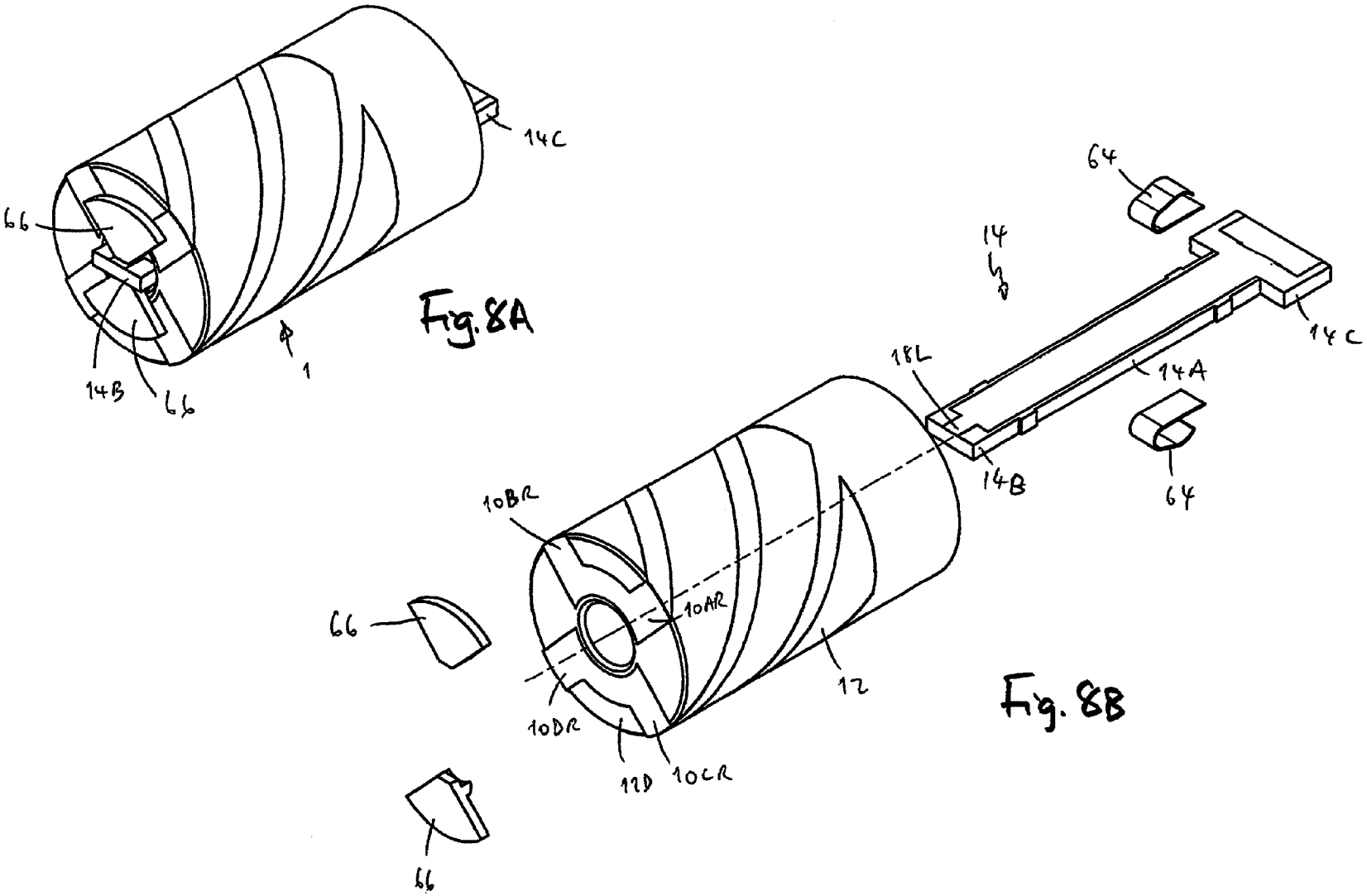
FIGS. 8A and 8B are, respectively, perspective assembled and exploded views of a fourth antenna.

Distal connection of the feed line to the distal surface portion conductive tracks using ears 66 is shown in FIGS. 8A and 8B.

Connection between the plated proximal end surface portion 12P of the core 12 and the proximal end portions of the feed line shield conductors 16U, 16L may be effected by a solder-coated washer 76, as shown in FIGS. 9A, 9B, 9C and 9D, the connection being made when the antenna is passed through an oven to melt the solder of the ring 76 so that it flows onto the proximal surface plating and the outer conductive layers of the elongate laminate board 14.

Figure 9A:
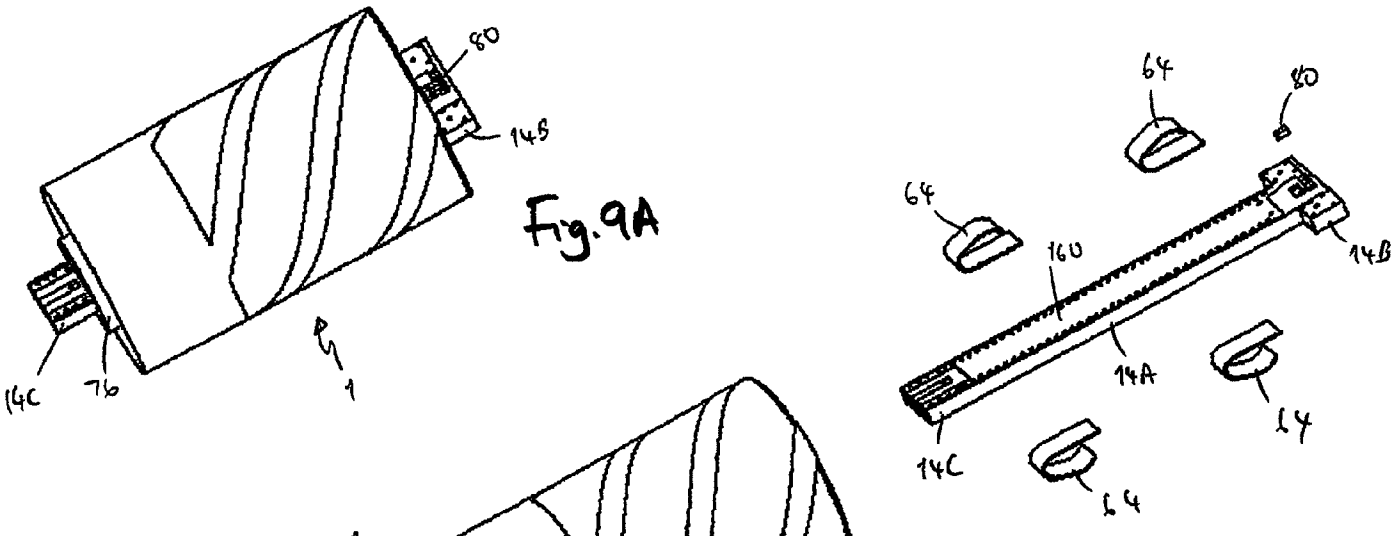
FIGS. 9A to 9F are various views of a fifth antenna and parts thereof.
Figure 9B:
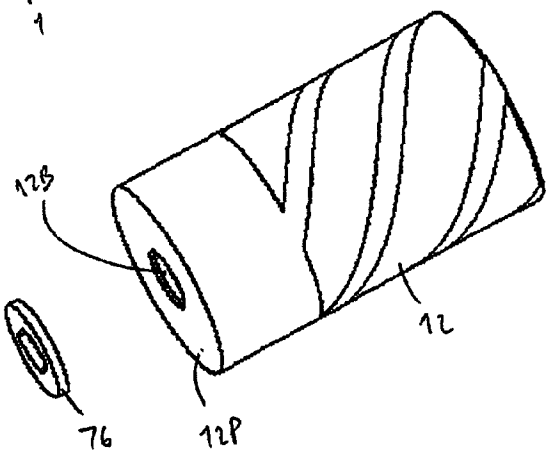
Figure 9E:
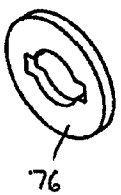
Figures 9C, 9D:
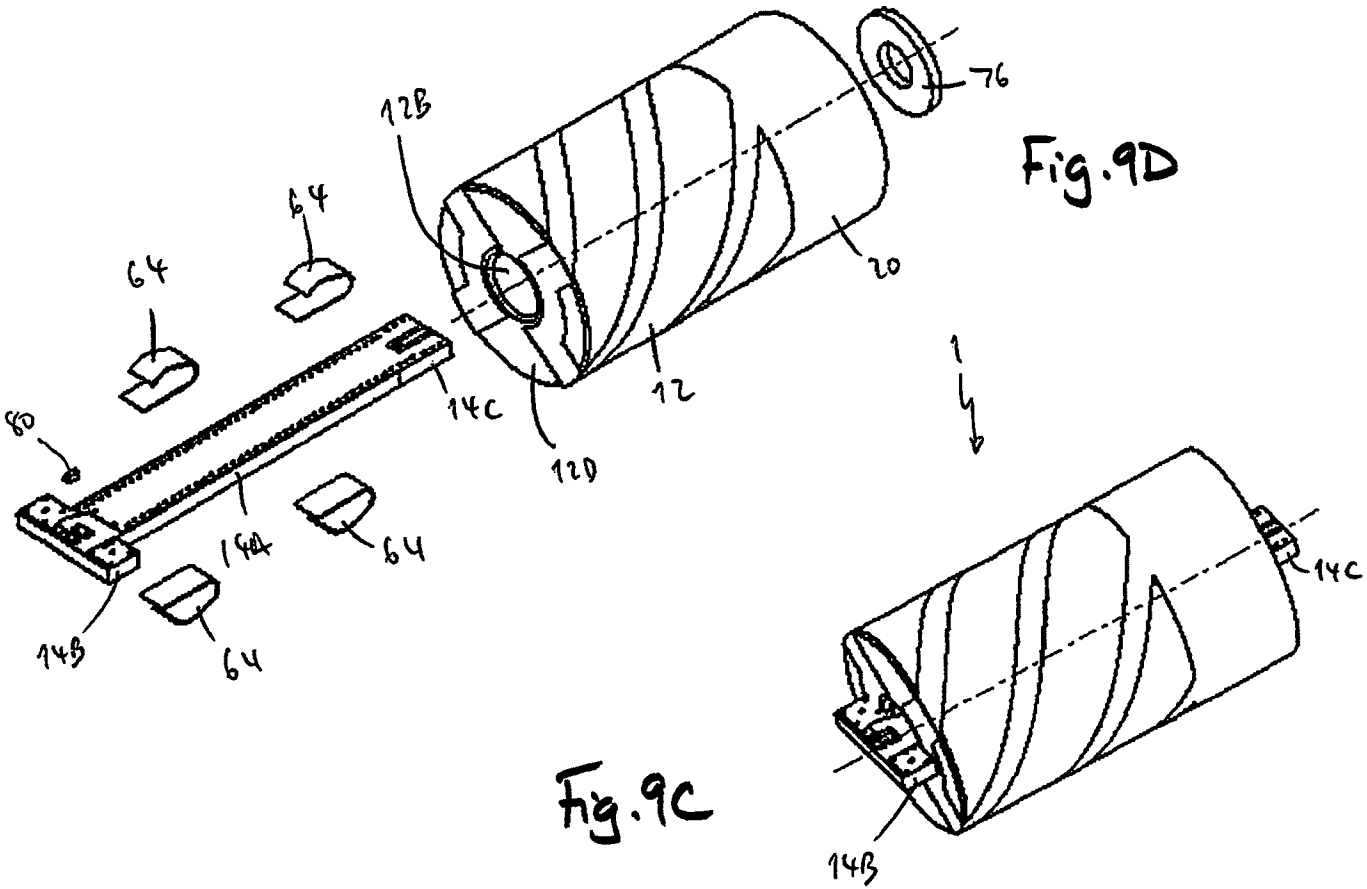

Close contact between the inner edge of the solder-coated washer 76 is achieved by providing a slotted aperture, as shown in FIG. 9E. In this case, the distal extension 14B of the laminate board 14 is of greater width than the transmission line section 14A in order more easily to accommodate matching components directly on the elongate laminate board 14, as shown in FIG. 9B.

Figure 9F:
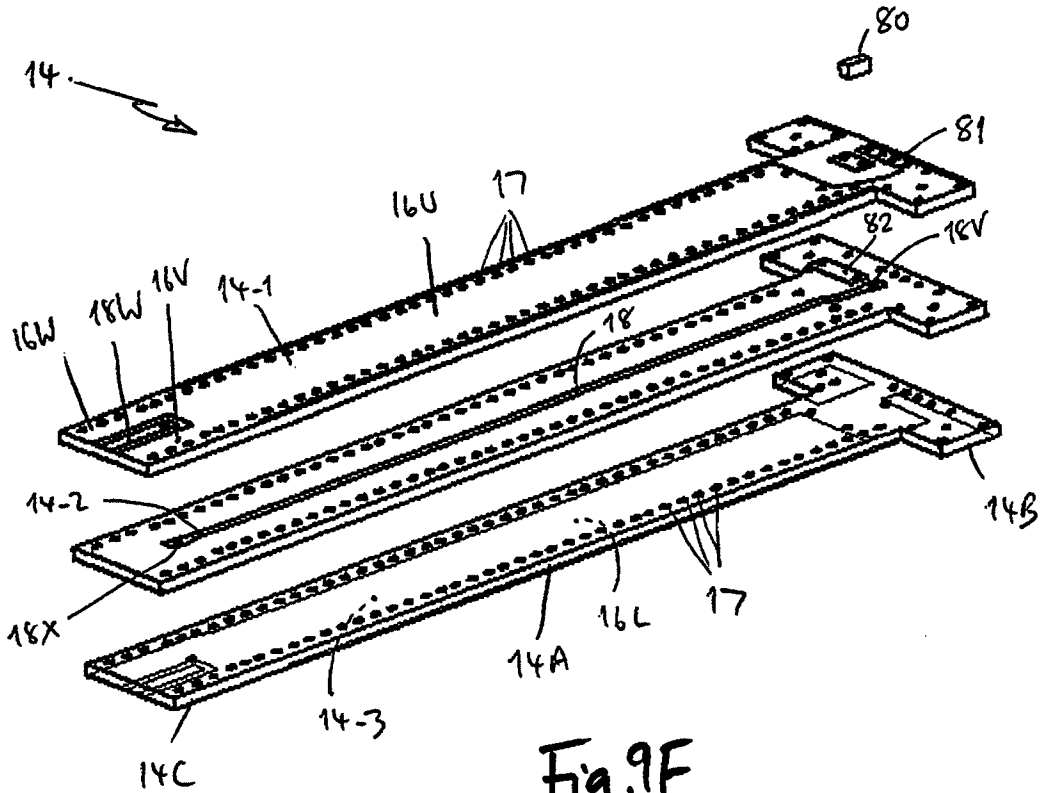

The construction of the laminate board 14 of the antenna shown in FIGS. 9A-9D will now be described in more detail with reference to FIG. 9F. The board has three conductive layers as follows: an upper conductive layer 14-1, an intermediate conductive layer 14-2 and a lower outer conductive layer (shown in phantom lines in FIG. 9F) 14-3. The inner layer forms a narrow elongate feed line conductor 18. The outer layers form shield conductors 16U, 16L as described hereinbefore. Extending between the shield conductors 16U, 16L, as described hereinbefore, are two lines of plated vias 17 which, in conjunction with the shield conductors 16U, 16L form a shield enclosing the inner conductor 18. The proximal extension 14C of the transmission line section 14A has contact areas 16V, 18W, 16W connected to the feed line conductors, as described above with reference to FIG. 1B.

In this example, the enlarged distal extension 14B constitutes a matching section replacing the second laminate board 30 of the first antenna described above with reference to FIGS. 1A and 1B. The matching section has a shunt capacitance provided by a discrete surface-mount capacitor 80, this component being mounted on pads formed in the outer conductor layer 14-1 connected respectively to the inner conductor 18 through a via 18V and an extension 81 of the feed line shield conductor 16U. A series inductance is formed in the intermediate layer 14-2 by a transverse element 82 and associated vias.

Connection of the matching network on the distal extension 14B of the laminate board 14 is effected by soldered joints between the outer conductive layers on the laterally projecting portions of the distal extension 14B and the conductors provided by the patterned conductive layer on the distal end surface portion of the core.

Figures 10A, 10B:
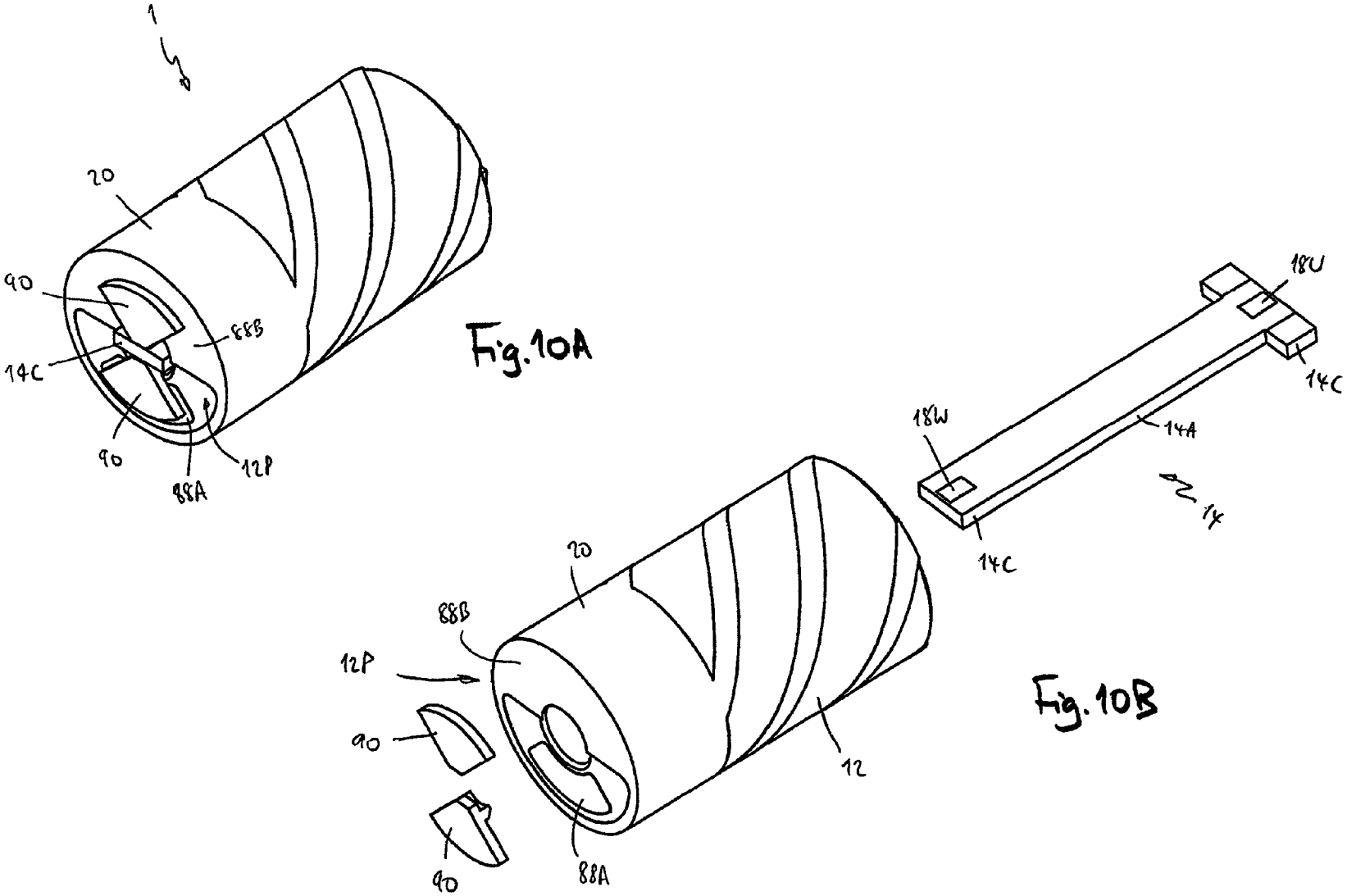
FIGS. 10A and 10B are, respectively, perspective assembled and exploded views of a sixth antenna.

It is not necessary for connections between the antenna feed line and an equipment circuit board to be made by contact areas extending in a plane parallel to the antenna axis. Referring to FIGS. 10A and 10B, contact areas oriented perpendicularly to the antenna axis may be provided on the proximal end surface portion 12P of the core 12. In this case, the plating of the proximal end surface portion 12P may be patterned so as to provide an isolated "land" 88A insulated from the plating 88B formed as a continuation of the conductive sleeve 20. Patterning of the proximal conductive layer 88A, 88B on the core 12 in this way provides conductive base areas for affixing fan-shaped conductive bearing elements 90 the inner ends of which are shaped to be connected to contact areas (e.g., conductive pad 18W) on the proximal extension 14C of the transmission line section 14A (such areas being on opposite faces of the laminate board 14). The bearing elements 90 are bonded to the respective conductive layer portions 88A, 88B to form firm and wear-resistant contact areas oriented perpendicularly to the antenna axis and to receive abutting spring contacts, as shown in FIG. 11.

Figure 11:
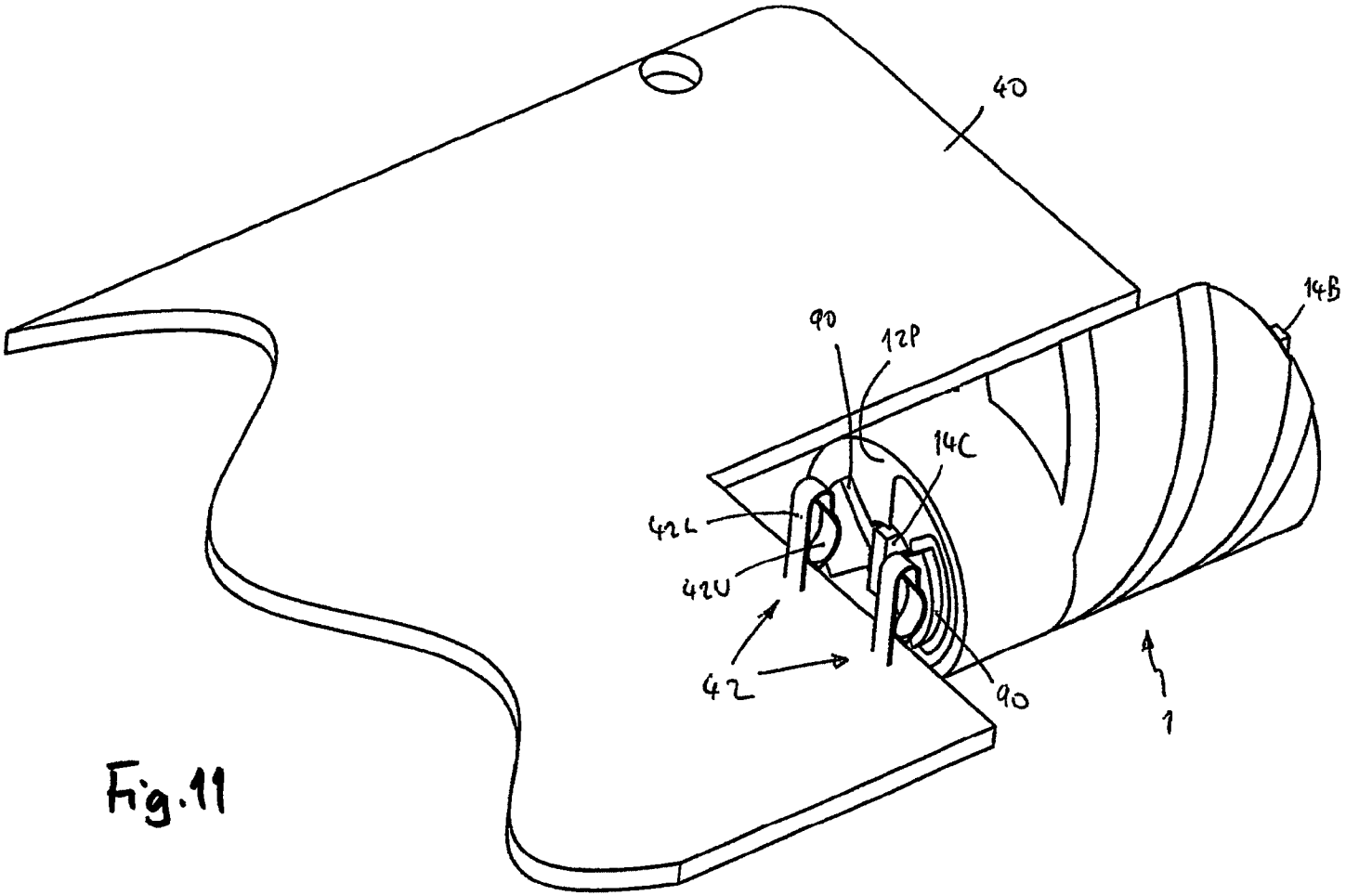
FIG. 11 is a perspective view of part of a radio communication unit including the sixth antenna.

Referring to FIG. 11, an equipment circuit board 40, in this case, has upstanding metallic leaf spring contacts 42 having fixing legs 42F secured in holes (not shown) adjacent an edge of the circuit board 40 and spaced apart so as to be in registry with the spaced-apart bearing elements 90 bonded to the proximal end surface portion 12P of the antenna core 12. Each spring contact has a contacting leg 42U which bears resiliently against the bearing elements 90 in a direction parallel to the axis of the antenna.

Figure 12:
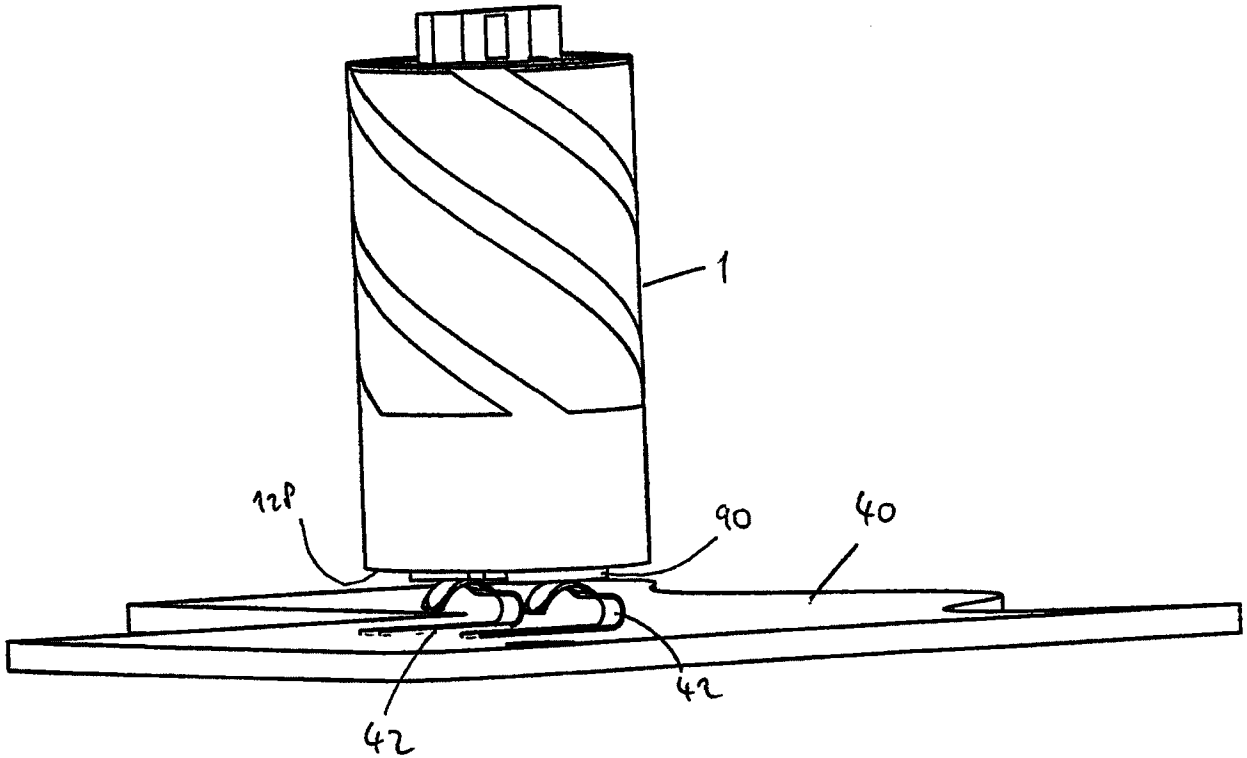
FIG. 12 is a perspective view of an alternative radio communication unit including the sixth antenna.

The same perpendicularly oriented bearing elements may be used for so-called "turret" mounting of the antenna on the face of an equipment circuit board 40, as shown in FIG. 12. In this case, the spring contacts 42 are surface mounted on the board 40 as shown in FIG. 12. Resilient approaching movement of the contacting legs of the spring contacts 42 in the direction of the fixing legs, in the same manner as described above with reference to FIG. 2, occurs when the antenna 1 is urged into position over the circuit board 40 with a predetermined spacing between the proximal end surface portion 12P and the opposing surface of the circuit board 40 during assembly of the antenna into the equipment of which the circuit board 40 is part.

Figures 13A, 13B:
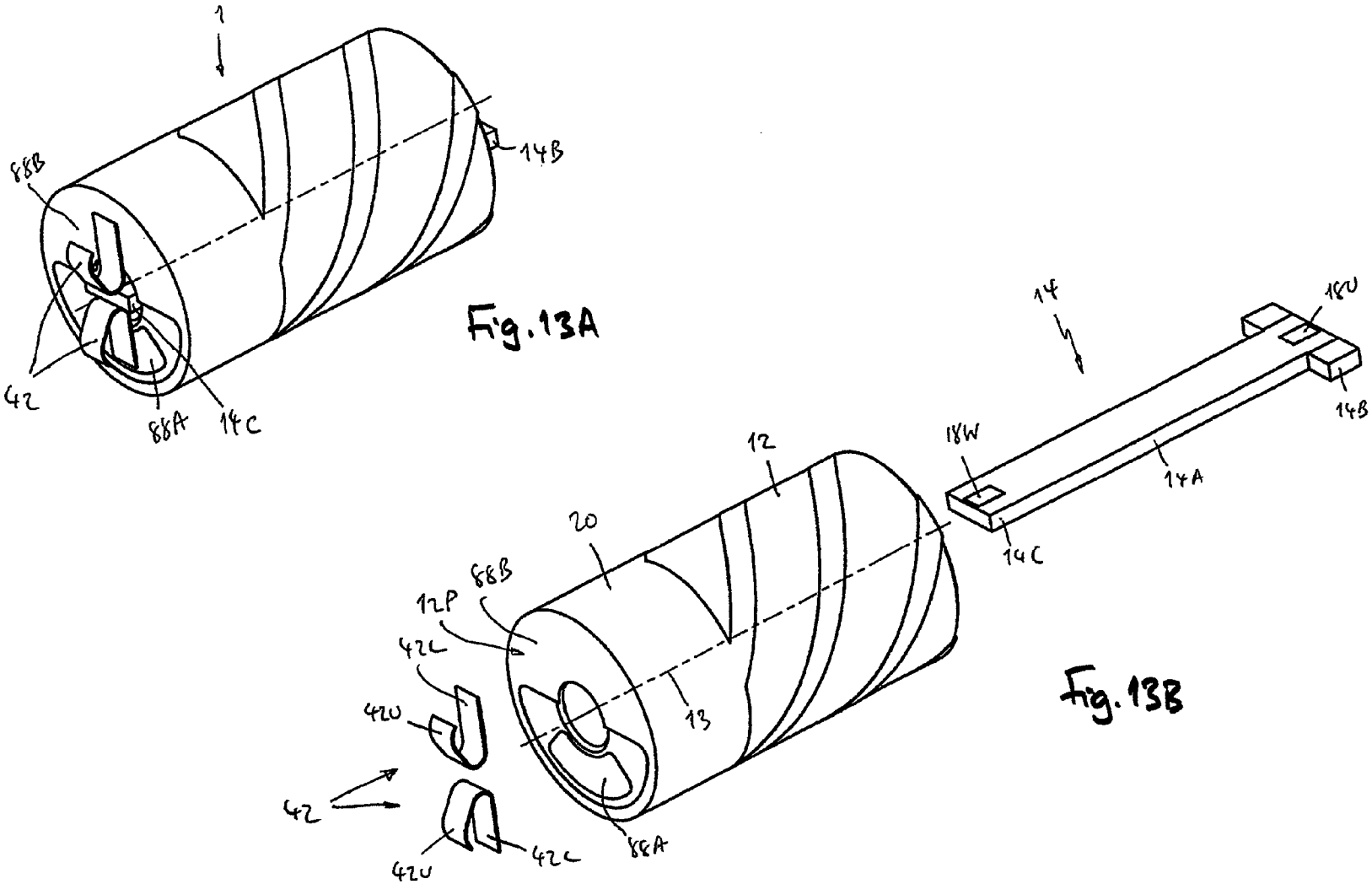
FIGS. 13A and 13B are, respectively, perspective assembled and exploded views of a seventh antenna.

An alternative means of connecting the antenna to an equipment circuit board in a turret-mounted configuration is shown in FIGS. 13A and 13B. In this case, the conductive layer plated on the proximal end surface portion 12P of the antenna core 12 is patterned as described above with reference to FIGS. 10A and 10B. In this case, however, connections to the feed line of the elongate laminate board 14 are made by a pair of spring contact elements 42 mounted in a diametrically opposing manner on, respectively, the land conductor area 88A and the sleeve-connected conductive area 88B. In each case, the fixing leg 42L is soldered to the respective conductive area so that the contacting legs 42U are oriented to bear against contact areas on an equipment circuit board (not shown) extending parallel to the proximal end surface portion 12P of the antenna core and perpendicular to the antenna axis 13, the antenna being at a predetermined spacing set according to the required compression of the spring contacts 42. Moreover, these spring contacts are oriented such that the resilient interconnection between the fixing leg and contacting leg, in each case, faces inwardly towards the axis and is spaced therefrom so as to bear against contact areas on the proximal extension 14B of the transmission line section 14A of the laminate board 14, as shown in FIGS. 13A and 13B.

The invention claimed is:

1. Radio communication apparatus comprising:

(a) a backfire dielectrically loaded antenna for operation at a frequency in excess of 200 MHz comprising:

an electrically insulative dielectric core of a solid material having a relative dielectric constant greater than 5 and having an outer surface including oppositely directed distal and proximal surface portions extending transversely of an axis of the antenna and a side surface portion extending between the transversely extending surface portions, the core outer surface defining an interior volume the major part of which is occupied by the sold material of the core;

a three-dimensional antenna element structure including at least one pair of elongate conductive antenna elements disposed on or adjacent the side surface portion of the core and extending from the distal core surface portion towards the proximal core surface portion;

a feed structure in the form of an axially extending elongate laminate board comprising at least a transmission line section acting as a feed line which extends through a passage in the core from the distal core surface portion to the proximal core surface portion, the antenna having exposed contact areas on or adjacent the core proximal surface portion; and (b) radio communication circuit means having an equipment laminate circuit board with at least one conductive layer, the conductive layer or layers having a plurality of contact terminal support areas to each of which is conductively bonded a respective spring contact positioned so as to bear resiliently against respective ones of the exposed contact areas of the antenna.

2. Apparatus according to claim 1, wherein the spring contacts each comprise a metallic leaf spring element individually bonded to its respective said contact terminal support area.

3. Apparatus according to claim 1, wherein the exposed contact areas of the antenna lie parallel to the plane of the equipment laminate circuit board.

4. Apparatus according to claim 1, wherein each spring contact is shaped to exert an engagement force acting perpendicularly to the plane of the equipment circuit board.

5. Apparatus according to claim 1, wherein the exposed contact areas of the antenna lie perpendicularly with respect to the antenna axis and the spring contacts are shaped to deform resiliently in response to a compression force directed generally axially of the antenna.

6. Apparatus according to claim 1, wherein the exposed contact areas of the antenna lie substantially parallel to the antenna axis and the spring contacts are shaped to deform resiliently in response to a compression force directed generally perpendicularly to the antenna axis.

7. Apparatus according to claim 5, wherein the exposed contact areas are located on the proximal surface portion of the antenna core.

8. Apparatus according to claim 7, wherein the proximal surface portion of the antenna core has a conductive layer having first and second areas electrically insulated from each other, the first conductive area being connected to a first conductor of the feed line and the second conductive area being connected to a second conductor of the feed line, and wherein the antenna further comprises conductive leaf members bonded to respective ones of the said conductive areas and constituting the connections between the feed line conductors and the said areas, the leaf members forming the said exposed contact areas.

9. Apparatus according to claim 6, wherein the axially extending elongate laminate board of the antenna has an integrally formed proximal extension of the transmission line section, and wherein the said exposed contact areas of the antenna comprise conductive areas on the said extension, the conductive areas being connected to respective ones of the feed line conductors.

10. Apparatus according to claim 9, having three spring contacts on the equipment circuit board, arranged side-by-side, the exposed contact areas on the antenna being arranged on one face of the laminate board proximal extension, each exposed contact area being in registry with a respective one of the three spring contacts.

11. Apparatus according to claim 1, wherein the spring contacts each comprise a respective folded metal spring element shaped so as to have a fixing leg and a contacting leg, the contacting leg approaching the fixing leg when the spring is deformed by a compressive contact force.

12. A method of assembling the radio communication apparatus of any preceding claim, the apparatus further comprising a two-part housing for the antenna and the equipment circuit board, the housing having a receptacle shaped to receive the antenna and to locate it in a preselected position with respect to the circuit board, in which position the spring contacts are in registry with and bear against the respective contact areas of the antenna, wherein the method comprises securing the circuit board in the housing, placing the antenna in the receptacle, and bringing the two parts of the housing together in an assembled condition, the action of bringing the two parts together urging the spring contacts against the respective contact areas on the antenna thereby compressively deforming the spring contacts.

13. A method according to claim 12, wherein the two parts of the housing are snapped together.

14. A backfire dielectrically loaded antenna for operation at a frequency in excess of 200 MHz comprising:

an electrically insulative dielectric core of a solid material having a relative dielectric constant greater than 5 and having an outer surface including oppositely directed distal and proximal surface portions extending transversely of an axis of the antenna and a side surface portion extending between the transversely extending surface portions, the core outer surface defining an interior volume, the major part of which is occupied by the solid material of the core;

a three-dimensional antenna element structure including at least one pair of elongate conductive antenna elements disposed on or adjacent the side surface portion of the core and extending from the distal core surface portion towards the proximal core surface portion; and a feed structure comprising first and second feed conductors which extend axially through a passage in the core from the distal core surface portion to the proximal core surface portion;

wherein the proximal core surface portion has a conductive coating patterned to form at least two conductive areas electrically separated from each other, and wherein the antenna further comprises electrical connections, at the proximal end of the passage, between each feed conductor and a respective one of the conductive areas on the proximal core surface portion, the arrangement thereby providing at least a pair of planar contact surfaces on the proximal core surface portion for mounting the antenna on a host equipment board with the axis of the antenna perpendicular to the equipment board.

15. An antenna according to claim 14, wherein the feed structure is an axially extending elongate laminate board comprising at least a transmission line section acting as a feed line which extends through the passage in the core.

16. An antenna according to claim 15, wherein the laminate board has a proximal end portion in registry with the proximal core surface portion, which proximal end portion bears at least two conductive pads on opposite faces of the board, one connected to a first feed line conductor of the transmission line section, the antenna further comprising conductive bridging elements linking the pads to the conductive areas of the proximal core surface portion coating.

17. An antenna according to claim 16, wherein the laminate board has first, second and third conductive layers, the second layer being an intermediate layer between the first and third layers, and wherein the feed line comprises an elongate inner conductor formed by the second layer and outer shield conductors overlapping the inner conductor respectively above and below the latter formed by the first and third layers respectively, wherein one of the shield conductors terminates short of the laminate board proximal end portion and the inner feed conductor is connected to a conductive pad on the laminate board proximal end portion on the same face of the boards as the said one shield conductor and spaced from the latter.

* * * * *